US012560160B2

(12) United States Patent
Bleier

(10) Patent No.: US 12,560,160 B2
(45) Date of Patent: Feb. 24, 2026

(54) PUMP CONTROLLER ASSEMBLY

(71) Applicant: Keco Inc., San Diego, CA (US)

(72) Inventor: Andrew Bleier, San Diego, CA (US)

(73) Assignee: Keco Inc., San Diego, CA (US)

( * ) Notice: Subject to any disclaimer, the term of this patent is extended or adjusted under 35 U.S.C. 154(b) by 56 days.

(21) Appl. No.: 18/377,934

(22) Filed: Oct. 9, 2023

(65) Prior Publication Data

US 2024/0117804 A1 Apr. 11, 2024

Related U.S. Application Data

(60) Provisional application No. 63/414,324, filed on Oct. 7, 2022.

(51) Int. Cl.

| | |
|---|---|
| ***F04B 49/06*** | (2006.01) |
| ***F04B 35/04*** | (2006.01) |
| ***F04B 35/06*** | (2006.01) |
| ***F04B 43/12*** | (2006.01) |

(52) U.S. Cl.

CPC ..... *F04B 49/065* (2013.01); *F04B 35/04* (2013.01); *F04B 35/06* (2013.01); *F04B 43/12* (2013.01)

(58) Field of Classification Search

CPC ..... F04B 35/04; F04B 35/06

See application file for complete search history.

(56) References Cited

U.S. PATENT DOCUMENTS 4,621,984 A * 11/1986 Fussell ..... F04B 35/06 417/234

5,249,932 A * 10/1993 Van Bork ..... F04B 43/067 417/63

5,725,358 A * 3/1998 Bert ..... F04B 13/00 417/415

5,971,711 A * 10/1999 Noji ..... F04D 25/16 417/2

6,364,639 B1 * 4/2002 DiCarlo ..... F16N 13/04 417/555.1

(Continued)

FOREIGN PATENT DOCUMENTS

WO 2018160175 A1 9/2018

OTHER PUBLICATIONS

"What is a turndown ratio . . . ", 2020.*

(Continued)

*Primary Examiner* — Christopher S Bobish

(74) *Attorney, Agent, or Firm* — Dinsmore & Shohl LLP

(57) ABSTRACT

Embodiments provided herein relate to a pump controller assembly for a positive displacement pump, the pump controller assembly including a servomotor, an enclosure assembly having a housing and communicatively coupled to the servomotor, the enclosure assembly including a controller, a power supply, a terminal block, and a plurality of field connectors, and a human machine interface positioned above the servomotor in a vertical direction, the human machine interface communicatively coupled to the enclosure assembly, the human machine interface including a housing and a display touch-screen interface positioned at least partially within the housing, wherein the controller is configured to control the servomotor via a plurality of pulse signals, and the controller is configured to receive commands from the human machine interface.

20 Claims, 20 Drawing Sheets

(56) References Cited

U.S. PATENT DOCUMENTS 6,375,437 B1 * 4/2002 Nolan ..... F04B 41/02 137/248
6,712,586 B2 3/2004 Koyano et al.
6,991,437 B2 * 1/2006 Cherry ..... F04B 41/02 417/234
7,473,080 B2 * 1/2009 Kawada ..... F04B 39/121 417/423.14
7,563,076 B2 7/2009 Brunet et al.
7,782,626 B2 * 8/2010 Buck ..... H01M 50/251 361/801
8,083,503 B2 * 12/2011 Voltenburg, Jr. ... F04B 43/1284 417/477.2
8,297,369 B2 10/2012 Gamble et al.
8,561,656 B2 * 10/2013 Eginton ..... F04B 43/12 222/255
8,667,783 B2 3/2014 Naydenov et al.
8,925,594 B2 * 1/2015 Ohm ..... F04B 35/04 141/94
9,670,034 B2 * 6/2017 Skotty ..... F04B 35/04
9,670,920 B2 * 6/2017 Vos ..... F04B 39/0061
9,810,210 B2 * 11/2017 Bassani ..... F04B 43/1292
9,869,309 B2 * 1/2018 Hays ..... F04B 53/16
10,927,826 B2 * 2/2021 Arnold ..... H01R 31/06
10,974,701 B2 * 4/2021 McIntyre ..... B60S 5/046
11,655,810 B2 * 5/2023 Hines ..... F04B 43/026 417/42
11,679,744 B2 * 6/2023 McIntyre ..... F04B 35/06 700/282
11,732,719 B2 * 8/2023 Lechner ..... F04D 1/003 417/2
11,754,064 B2 9/2023 Tracey et al.
11,808,257 B2 * 11/2023 Miller ..... F04B 35/06
12,012,953 B2 * 6/2024 Deem ..... F04B 17/03
12,060,872 B2 * 8/2024 Westling ..... F04B 35/04
12,078,160 B2 * 9/2024 White ..... F04B 39/066
12,135,023 B2 * 11/2024 Murphy ..... F04B 43/12
12,228,125 B2 * 2/2025 Smith ..... F04B 43/12
2006/0245937 A1 * 11/2006 Goodwin ..... F04B 35/06 417/234
2008/0232980 A1 * 9/2008 Huang ..... F04B 49/00 417/282
2010/0008755 A1 * 1/2010 McDowell ..... B25B 33/00 415/1
2011/0286859 A1 * 11/2011 Ortiz ..... F04B 49/002 417/20
2016/0123318 A1 5/2016 Villareal et al.
2016/0178084 A1 * 6/2016 White ..... F04B 35/01 137/553
2017/0122326 A1 * 5/2017 Dahlqvist ..... F04D 15/0281
2017/0239675 A1 * 8/2017 Svendsen ..... B05B 12/002
2018/0320677 A1 * 11/2018 Thackery ..... F04B 41/02
2018/0328356 A1 * 11/2018 Ortiz ..... F04D 13/0686
2019/0326838 A1 * 10/2019 Dion ..... F04B 41/02
2020/0063758 A1 2/2020 Ballesteros
2020/0164124 A1 5/2020 Zuo et al.
2020/0291936 A1 * 9/2020 Brocker ..... F04B 39/0022
2021/0206353 A1 * 7/2021 Mcintyre ..... F04B 35/06
2021/0291795 A1 * 9/2021 Mcintyre ..... F04B 49/08
2023/0184243 A1 * 6/2023 Ortiz ..... F04D 13/0686 417/313
2024/0052824 A1 * 2/2024 Miller ..... F04B 49/022
2024/0183347 A1 * 6/2024 Hines ..... F04B 53/16

OTHER PUBLICATIONS

Wayback Machine, 2015.*
Wohl Associates, Waukesha 045u2 Stainless Steel Jacketed Positive Displacement Pumps With Control Panel, https://www.wohlassociates.com/used-pumps-positive-displacement/waukesha-045u2-stainless-steel-jacketed-positive-displacement-pumps-with-control-panel.html, 1 page, Sep. 27, 2023.
Suzhou Macxi Fluid Technology Co., Ltd., Positive Displacement Pump with Servo Motor Spped Control, https://www.macxipump.com/hastelloy-6-00ml-rev-gear-pump/61739985.html, 2 pages, Sep. 27, 2023.

* cited by examiner

PUMP CONTROLLER ASSEMBLY

CROSS-REFERENCE TO RELATED APPLICATIONS

This application claims the benefit of and priority to U.S. Provisional Patent Application No. 63/414,324, filed on Oct. 7, 2022, the entire contents of which are hereby incorporated by reference.

INTRODUCTION

Field

The present disclosure generally relates to the field of pumps, and in particular, to an improved servomotor controlled pumps.

BACKGROUND

Industrial pumps, such as positive displacement pumps, are used in a wide variety of applications. One type of positive displacement pump is a peristaltic pump (or "roller pump"), which is commonly used for pumping a variety of fluids. Peristaltic pumps commonly work through rotary motion, and thus such pumps may use gearboxes and mechanical and electronic variable speed devices to adjust an operating (e.g., rotational) speed of the pump, which in-turn controls the output flow rate for the pump.

An important concept when considering the performance of a pump assembly (e.g., including a positive displacement pump) is the so-called "turndown ratio" of the pump assembly, which refers to the width of the operational range of the pump assembly as defined by the ratio of the maximum capacity to minimum capacity. By using ancillary devices, such as gearboxes, mechanical and electronic variable speed devices, and the like, a turndown ratio for a pump assembly may be adjusted or controlled for different applications. Generally, the industry standard turndown ratio for an industrial, non-cased peristatic pump is around 60:1. However, many applications of pump assemblies need higher turndown ratios for more demanding and precise pumping applications, such as dosing, transfer, and metering applications. Further, a higher turndown ratio may allow a single pump assembly to work on a wider variety of applications without the need for changing its physical configuration, such as changing a gearbox between a motor and the pump in the pump assembly.

As above, pump assemblies often include, or connect with, a motor for driving the pump. To achieve a high level of control of the output of a pump, variable frequency drives are often used to control motors by modifying a sine wave in the frequency range of 4-120 hertz (Hz). However, such variable frequency drives tend to not operate well or at all at lower frequencies (e.g., below 4 Hz), even if encoders are used on the motors. Consequently, specific gearboxes may be required to convert the operational range of a motor driving a pump into a useable operating range for the pump itself, but this generally constrains the overall operating range of the pump assembly. Further, such considerations may limit other operational characteristics of the pump, such as the output pressure a pump is able to maintain.

Further, traditional variable frequency drives are generally not capable of operating using a ground-fault circuit interrupter (GFCI) circuit breaker due to leakage current to ground, which means such systems cannot benefit from the safety of a GFCI power connection.

Accordingly, a need exists for pump assemblies having wider operating ranges and finer operational control (e.g., of pump speed) while maintaining beneficial operational characteristics of a given pump, such as the pump's output pressure.

In this specification, where reference has been made to external sources of information, including patent specifications and other documents, this is generally for the purpose of providing a context for discussing the features of the present disclosure. Unless stated otherwise, reference to such sources of information is not to be construed, in any jurisdiction, as an admission that such sources of information are prior art or form part of the common general knowledge in the art.

SUMMARY

The following embodiments may relate to any of the above aspects. Other aspects of the present disclosure may become apparent from the following description, which is given by way of example only and with reference to the accompanying drawings.

Aspects described herein relate to a pump controller assembly for a positive displacement pump, the pump controller assembly, comprising: a servomotor having a bracket; an enclosure assembly having a housing coupled to the bracket and communicatively coupled to the servomotor, the enclosure assembly comprising: a controller, a power supply, a terminal block, and a plurality of field connectors, a support member having a pair of legs and a connecting portion, the connecting portion is angled with respect to the pair of legs, the support member is coupled to the servomotor and to the housing of the enclosure assembly; and a human machine interface positioned above the servomotor in a vertical direction, the human machine interface communicatively coupled to the enclosure assembly, the human machine interface comprising: a housing coupled to the connecting portion of the support member, such that the housing is angled with respect to the servomotor; and a display touch-screen interface positioned at least partially within the housing, wherein: the controller is configured to control the servomotor via a plurality of pulse signals, and the controller is configured to receive commands from the human machine interface.

Another aspect provides a pump system, comprising: a plurality of servomotors; a plurality of positive displacement pumps, each one of the positive displacement pumps mechanically coupled to a respective one of the plurality of servomotors; an enclosure assembly coupled to one of the plurality of servomotors and communicatively coupled to each of the plurality of servomotors, the enclosure assembly comprising: a controller, a power supply, a terminal block, and a plurality of field connectors, wherein the terminal block or the plurality of field connectors are utilized to communicatively couple the controller to each of the plurality of servomotors; and a human machine interface communicatively coupled to the enclosure assembly, the human machine interface comprising: a housing coupled to the one of the plurality of servomotors; and a display touch-screen interface positioned at least partially within the housing, wherein: the controller is configured to control each of the plurality of servomotors via a plurality of pulse signals, and the controller is configured to receive commands from the human machine interface.

Another aspect provides a method for operating a system having a plurality of positive displacement pumps coupled to a plurality of pump controller assemblies, the method comprising: displaying, on a human machine interface, a graphical user interface to select a desired pump rate, the human machine interface communicatively coupled to a plurality of enclosure assemblies, each of the plurality of pump controller assemblies in the system having one of the plurality of enclosure assemblies and one of a plurality of servomotors, each one of the plurality of enclosure assemblies coupled to a bracket of a corresponding servomotor of the plurality of servomotors, each enclosure assembly of the plurality of enclosure assemblies having a controller, a power supply, a terminal block, and a plurality of field connectors; receiving, by the controller for each of the plurality of enclosure assemblies, the desired pump rate; and activating, by the controller for each of the plurality of enclosure assemblies, the corresponding servomotor of the plurality of servomotors via a plurality of pulse signals to output from the corresponding positive displacement pump of the plurality of positive displacement pumps the desired pump rate, wherein the terminal block or the plurality of field connectors of each enclosure assembly of the plurality of enclosure assemblies are utilized to communicatively couple the controller of each enclosure assembly of the plurality of enclosure assemblies to the corresponding servomotor of the plurality of servomotors.

Other aspects provide processing systems configured to perform the aforementioned methods as well as those described herein; non-transitory, computer-readable media comprising instructions that, when executed by a processors of a processing system, cause the processing system to perform the aforementioned methods as well as those described herein; a computer program product embodied on a computer readable storage medium comprising code for performing the aforementioned methods as well as those further described herein; and a processing system comprising means for performing the aforementioned methods as well as those further described herein.

The following description and the related drawings set forth in detail certain illustrative features of one or more aspects.

DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

A novel pump controller assembly is provided in various embodiments described herein, which in some cases may be referred to as a "universal pump controller assembly" owing to the flexibility of its application to new and existing hardware. In various embodiments, a pump controller assembly may include a pump (e.g., a positive displacement pump), a gearbox (e.g., a worm drive), a motor (e.g., a servomotor), an enclosure assembly that includes a controller, and an interface assembly (e.g., a touchscreen display). In some embodiments, the gearbox is mechanically coupled between the pump and the servomotor, while in others the motor may be directly connected to the pump. In some embodiments, the enclosure assembly further includes a power supply, a terminal block, and a plurality of field connectors. The interface assembly includes a human machine interface. In some embodiments, the arrangement of the pump controller assembly provides for a turndown ratio of at least 128,000:1 (e.g., corresponding to a controllable range of pump speed of 0.001 to 128 RPM) at maximum output pressure in excess of 200 PSI (e.g., in the range of 200-240 PSI). Beneficially, embodiments using a servomotor may provide a flow rate accuracy of, for example, 0.0010%, which enables application of the pump controller assembly to many operationally demanding use cases. Generally, pump assemblies including the pump controller assemblies describe herein far surpass the performance of conventional pump assemblies, such as those commonly available with a turndown ration of 60:1 and 1% accuracy.

Figure 1:
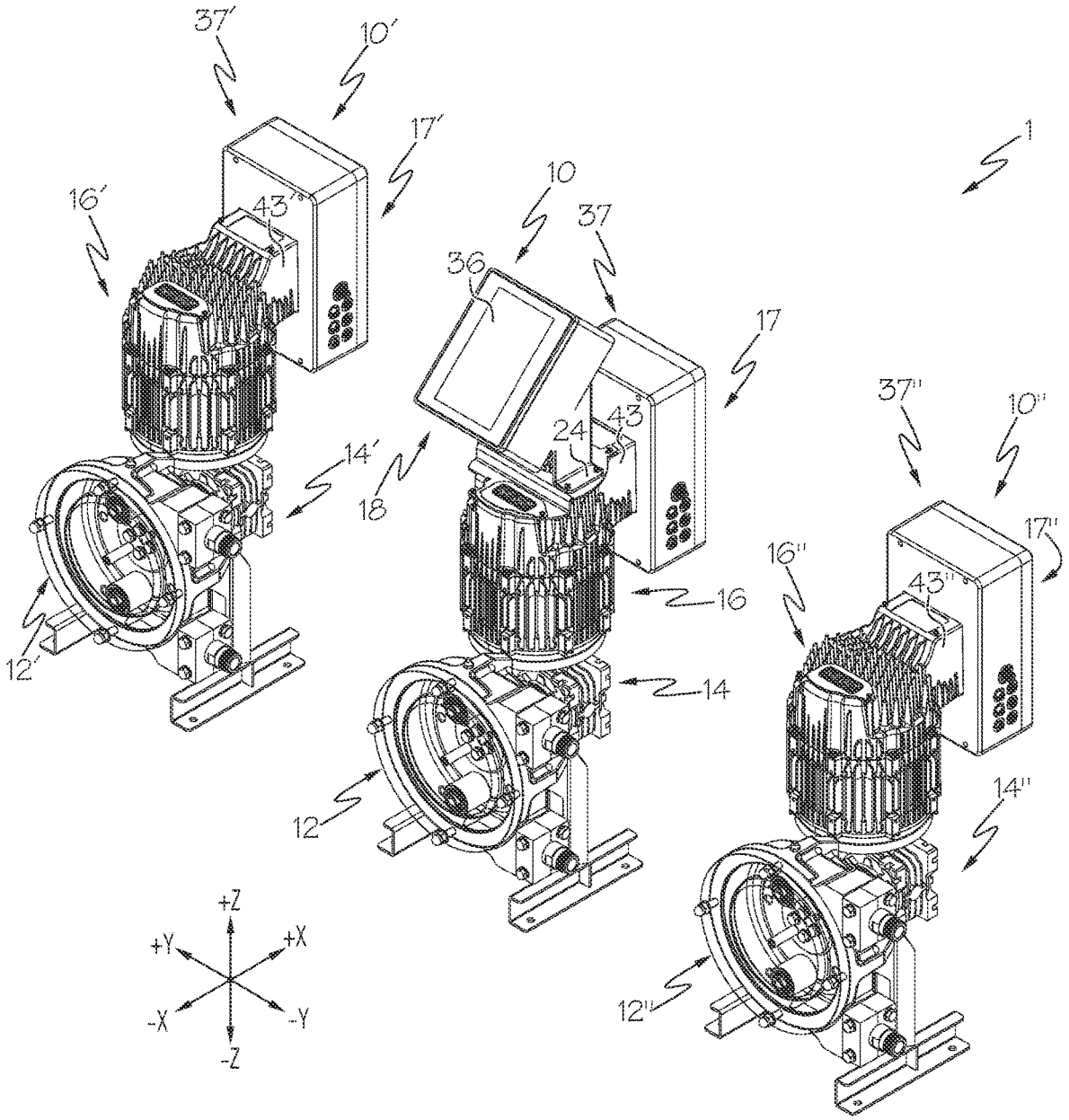
FIG. 1 schematically depicts a perspective view of a first example pump system that includes multiple example pump controller assemblies according to one or more embodiments shown and described herein.

As used herein, the term "longitudinal direction" refers to the forward-rearward direction of the pump assembly (i.e., in a +/−X direction of the coordinate axes depicted in FIG. 1). The term "lateral direction" refers to the cross-direction (i.e., along the Y axis of the coordinate axes depicted in FIG. 1), and is transverse to the longitudinal direction. The term "vertical direction" refers to the upward-downward direction of the pump assembly (i.e., in the +/−Z direction of the coordinate axes depicted in FIG. 1). As used herein, "upper" is defined as generally being towards the positive Z direction of the coordinate axes shown in the drawings. "Lower" is defined as generally being towards the negative Z direction of the coordinate axes shown in the drawings.

As used herein, the term "communicatively coupled" means that coupled components are capable of exchanging data signals and/or electric signals with one another such as, for example, electrical signals via conductive medium, electromagnetic signals via air, optical signals via optical waveguides, electrical energy via conductive medium or a non-conductive medium, data signals wirelessly and/or via conductive medium or a non-conductive medium and the like.

Referring now to FIG. 1, a first embodiment of a pump controller system 1 is schematically depicted. In the depicted embodiment, the pump controller system 1 includes a pump controller assembly 10, a pump controller assembly 10', and a pump controller assembly 10". This is non-limiting and the pump controller system 1 may include more or less pump controller assemblies. The pump controller assembly 10 is the primary pump controller for the pump controller system 1 and may be considered the "primary", while the pump controller assembly 10' and the pump controller assembly 10" may be considered the "secondary". It should be appreciated that each of the pump controller assembly 10, the pump controller assembly 10' and the pump controller assembly 10" are identical with the exceptions of the features described herein. As such, like features will use the same reference numerals with a "'" for the pump controller assembly 10' and a "'" for the pump controller assembly 10". As such, for brevity reasons, only the pump controller assembly 10 will be described in greater detail.

Still referring to FIG. 1 and now FIGS. 2A-5B, the pump controller assembly 10 includes a pump 12, a gearbox 14, a servomotor 16, and an enclosure assembly 17. The pump controller assembly 10 may further include or be communicatively coupled to an interface assembly 18. That is, the interface assembly 18 may be configured as the interface assembly for the pump controller assembly 10, and may control the pump controller assembly 10' and the pump controller assembly 10" (e.g., only one interface assembly 18 for the pump controller system 1), as discussed in greater detail herein.

The pump 12 may be a positive displacement pump such as, without limitation, a gear, lobe, diaphragm, progressive cavity type, and the like. As such, the pump 12, in the depicted embodiments, may be a peristaltic type pump. The pump may be configured to increase or provide a pressure or force on a fluid to move or pump the fluid. In various embodiments, the pump controller assembly 10 may be a standalone, retrofit, or OEM application pump system that may be directly coupled to an existing pump or mated to any gearbox to increase torque as required. As such, the pump 12 may be mechanically linked or coupled to the gearbox 14, as discussed in greater detail herein. The gearbox 14 may be configured to receive any positive displacement pump and may be interchanged or swapped with differing or the same type pump as needed (e.g., for improved field serviceability).

Figure 6:
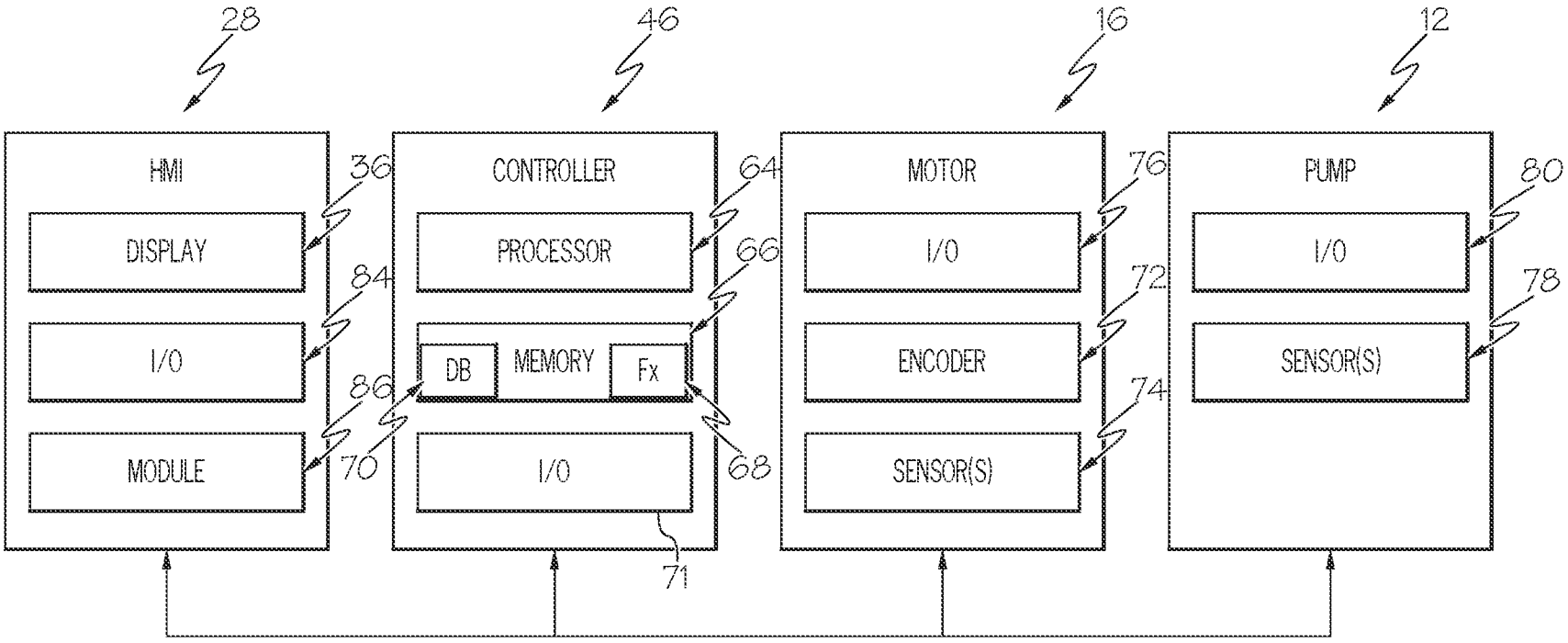
FIG. 6 schematically depicts an example processing architecture for the pump controller assembly of FIG. 1 according to one or more embodiments shown and described herein.
Figure 7:
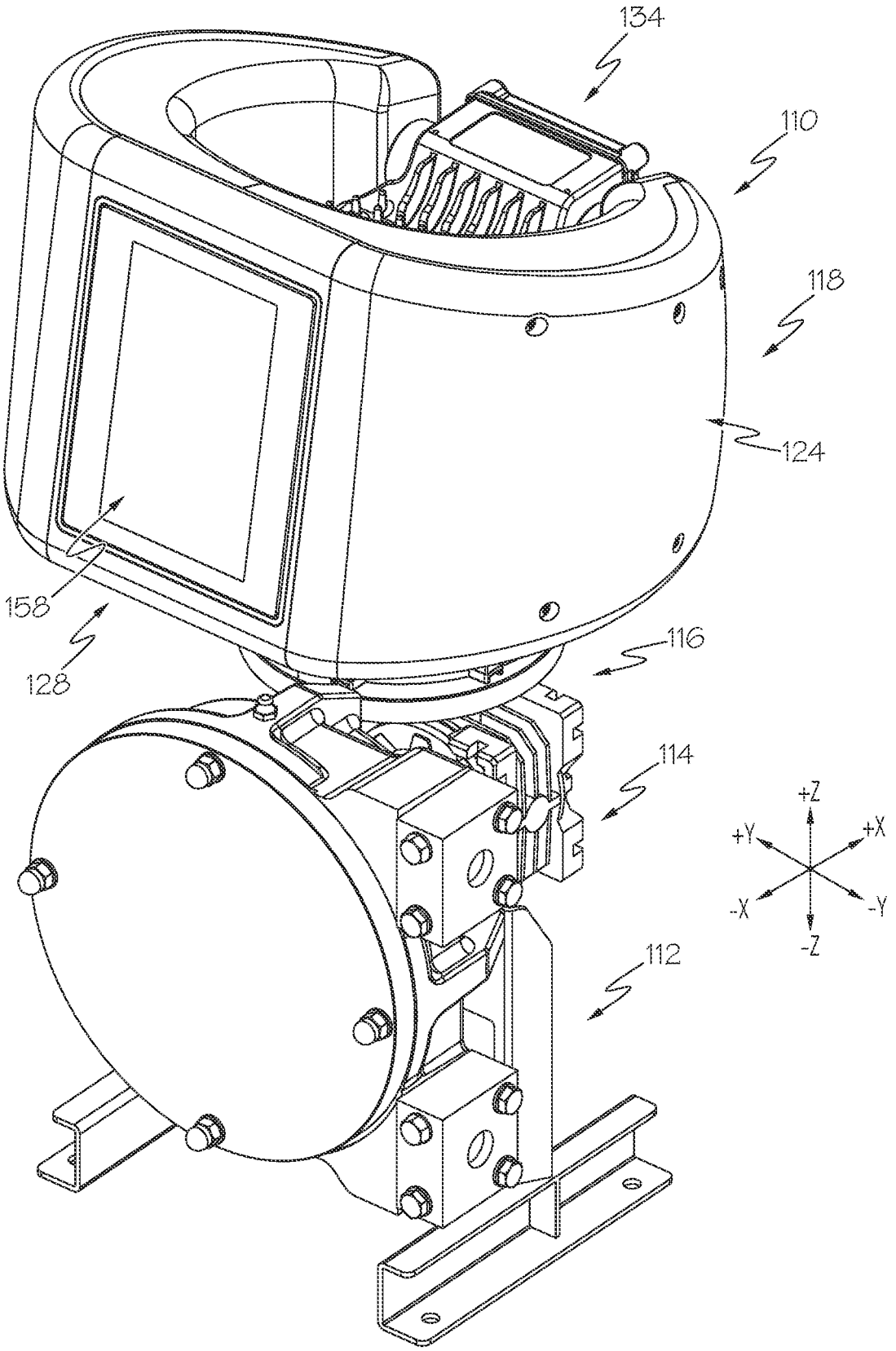
FIG. 7 schematically depicts a perspective view of an example pump controller assembly according to one or more embodiments shown and described herein.
Figure 8:
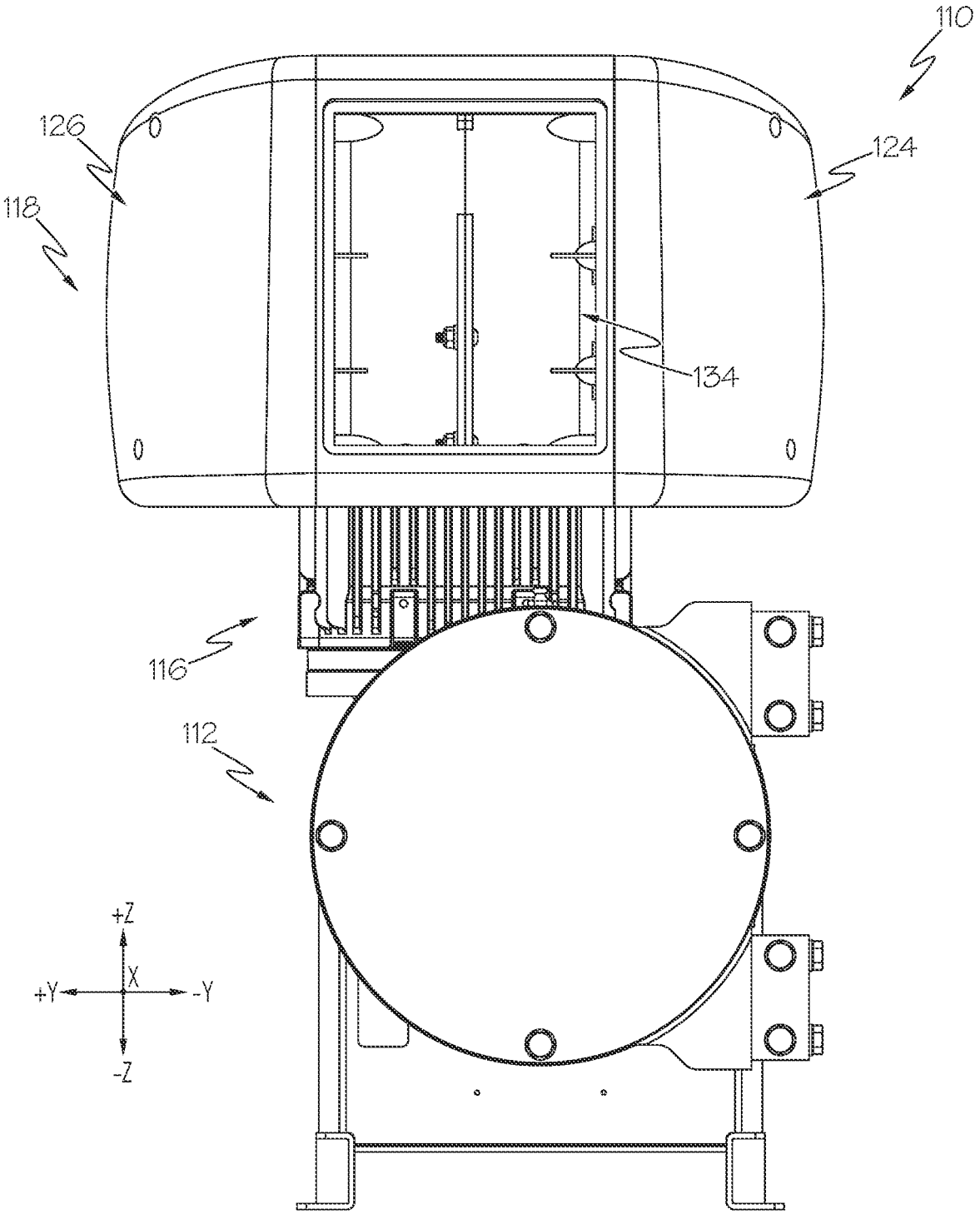
FIG. 8 schematically depicts a front view of the example pump controller assembly of FIG. 7 without a human machine interface according to one or more embodiments shown and described herein.
Figure 9:
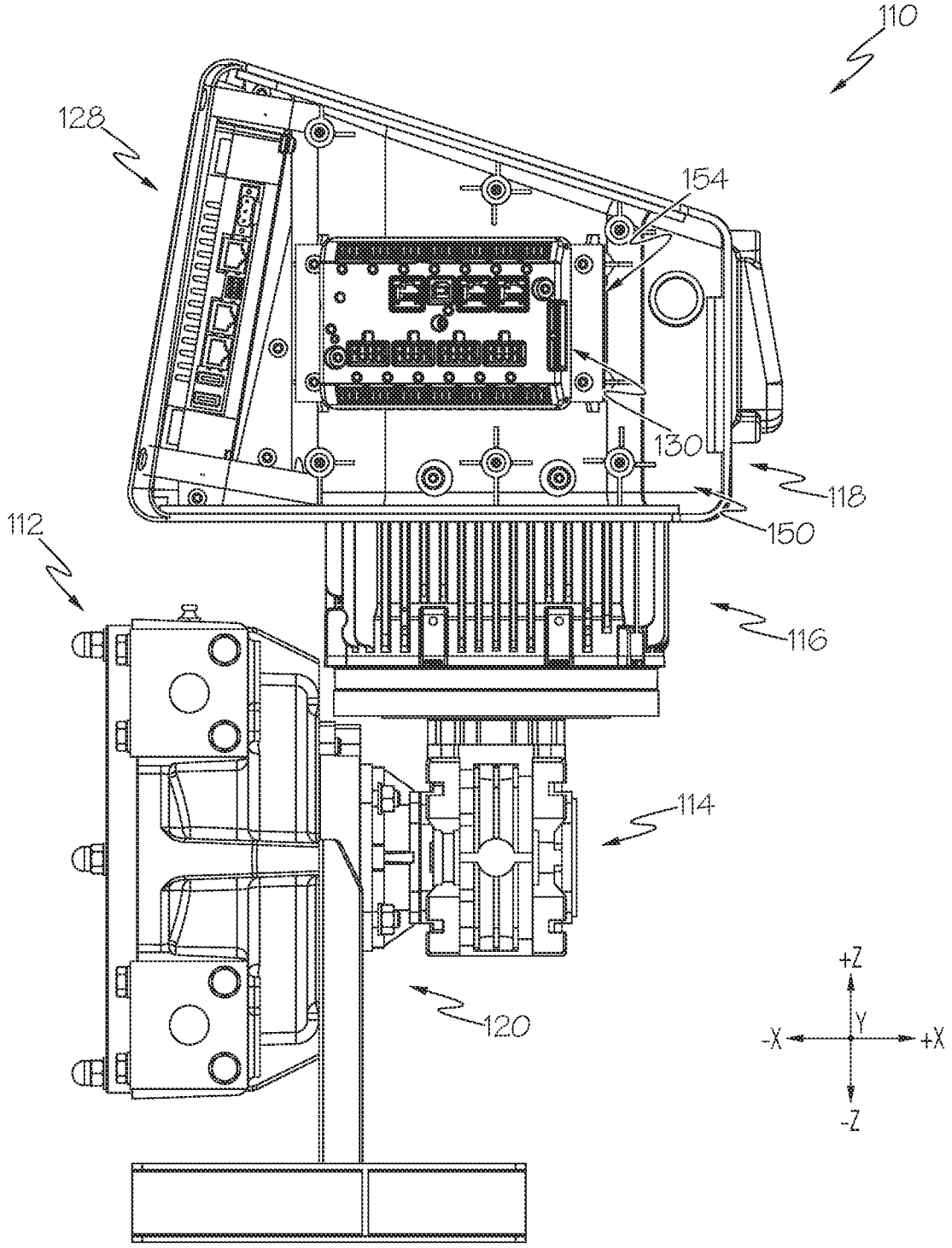
FIG. 9 schematically depicts a side view of the example pump controller assembly of FIG. 7 according to one or more embodiments shown and described herein.
Figure 10:
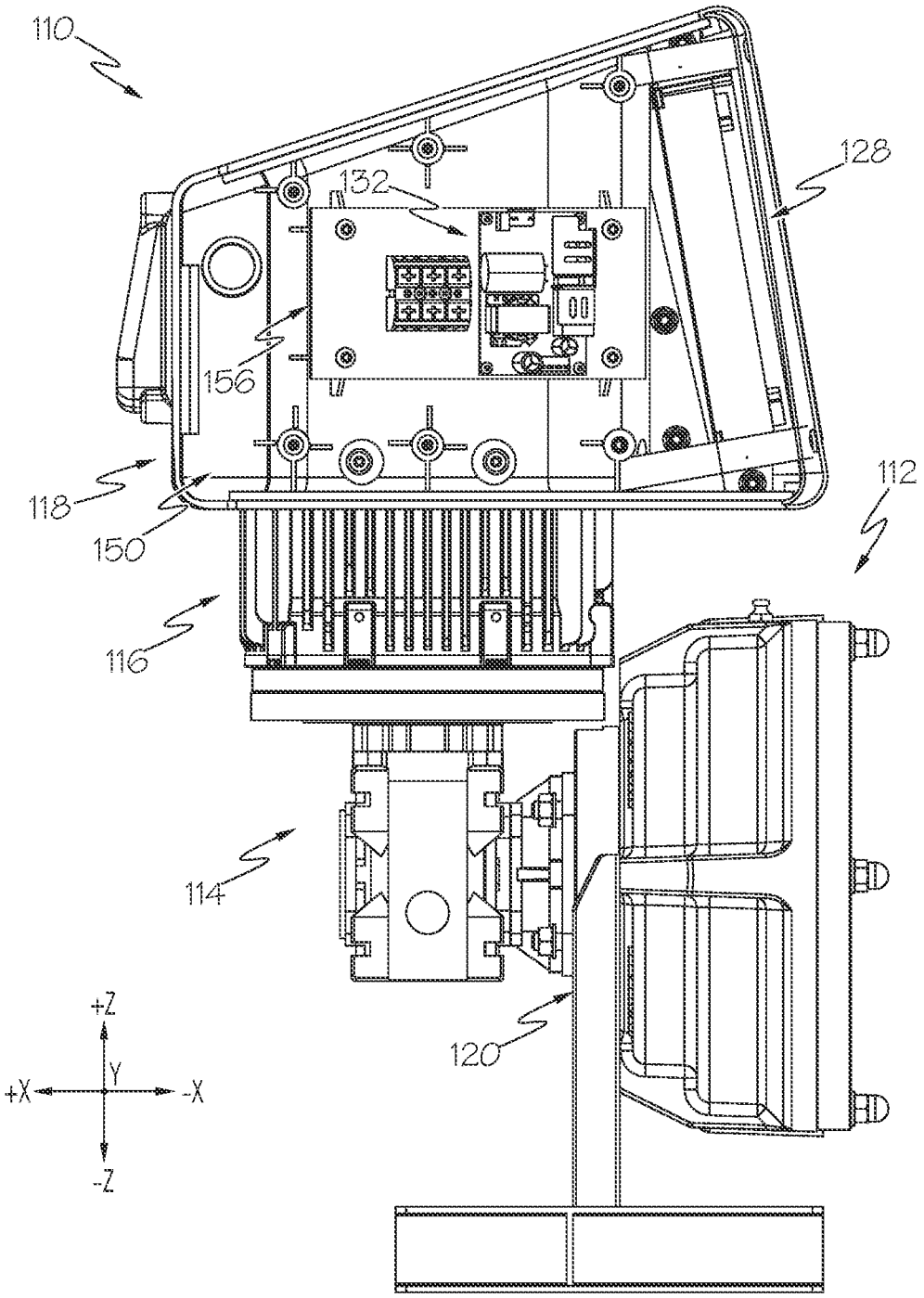
FIG. 10 schematically depicts another side view of the example pump controller assembly of FIG. 7 according to one or more embodiments shown and described herein.
Figure 11:
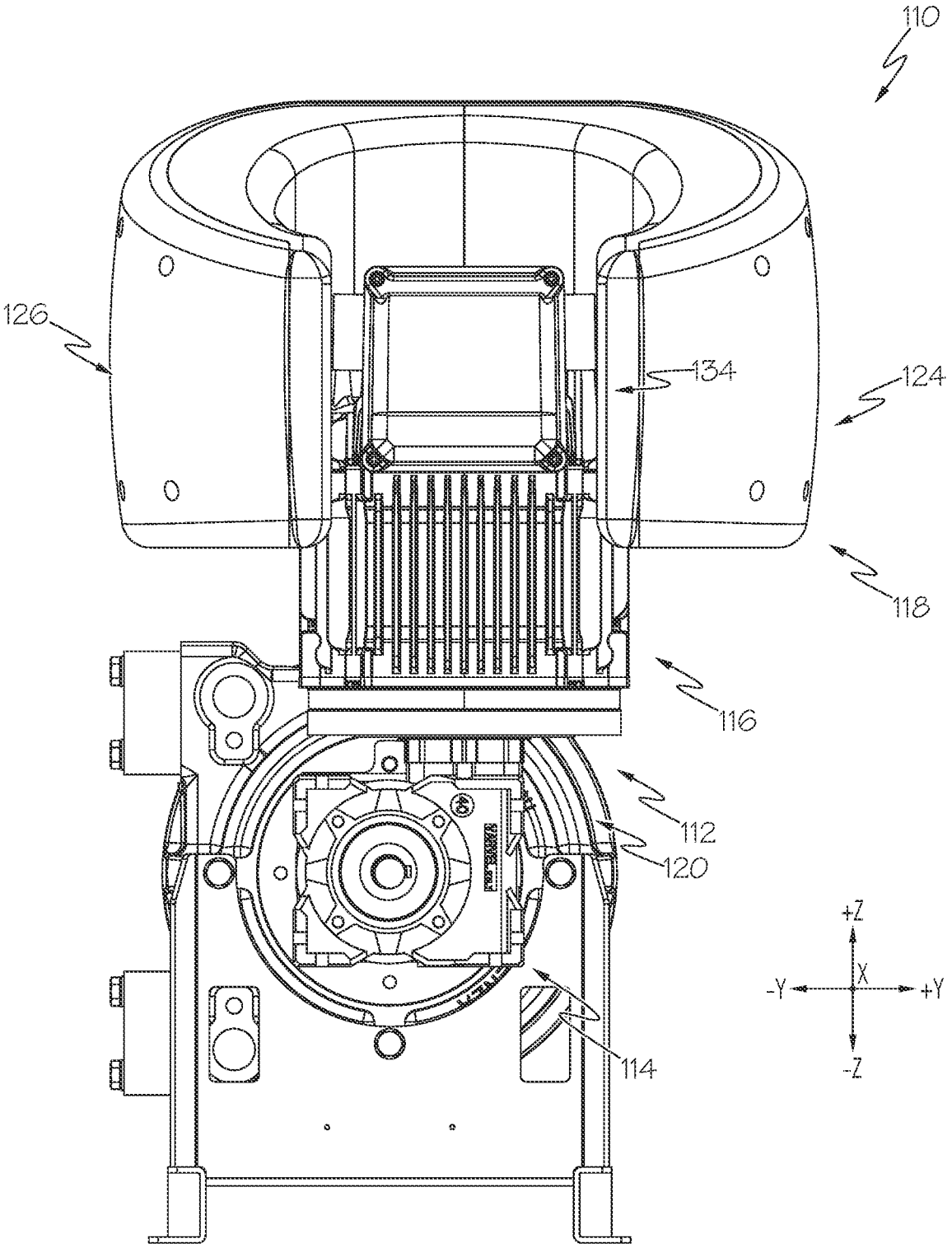
FIG. 11 schematically depicts a rear view of the example pump controller assembly of FIG. 7 according to one or more embodiments shown and described herein.
Figure 12:
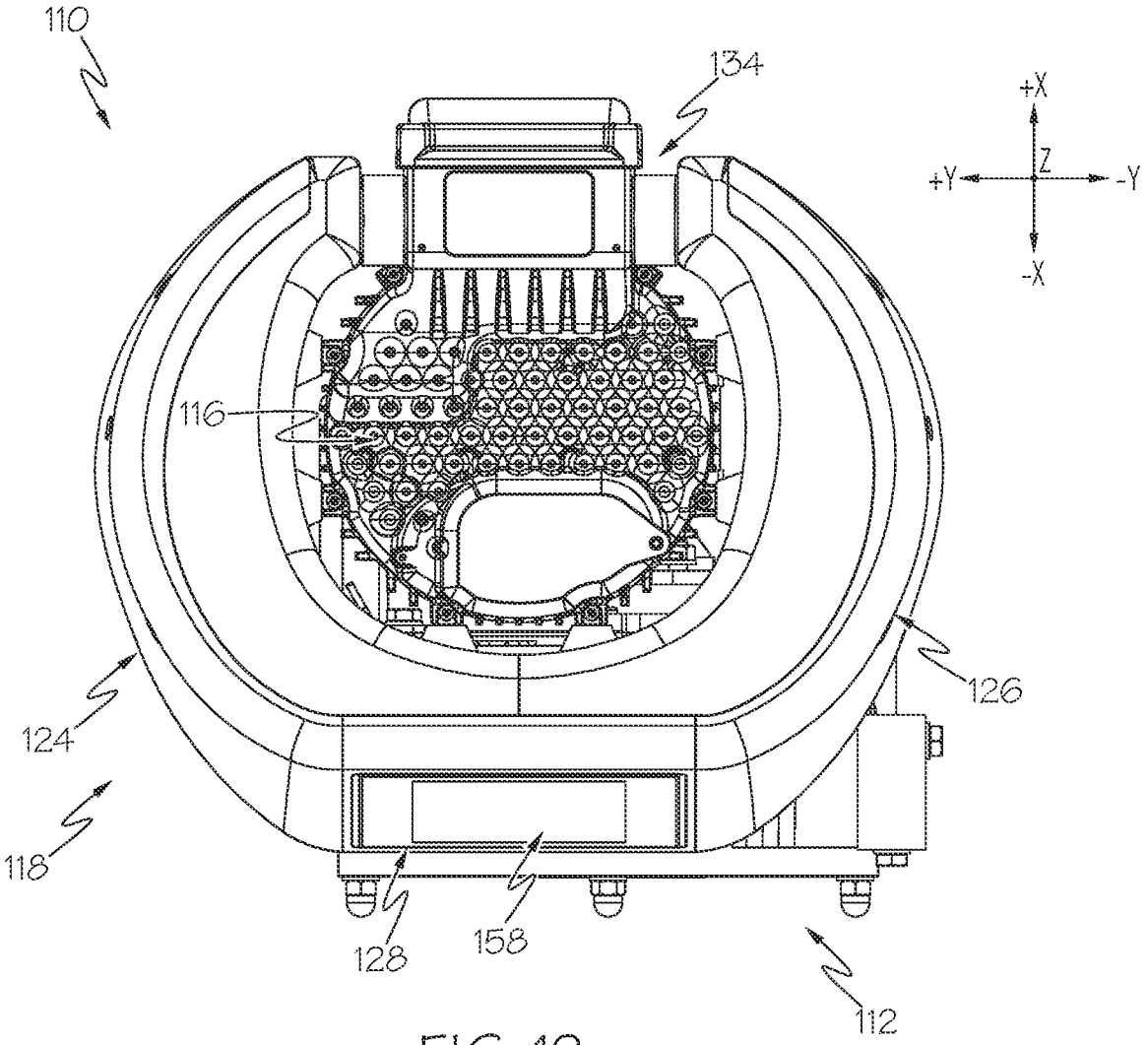
FIG. 12 schematically depicts a top-down view of the example pump controller assembly of FIG. 7 according to one or more embodiments shown and described herein.
Figure 13:
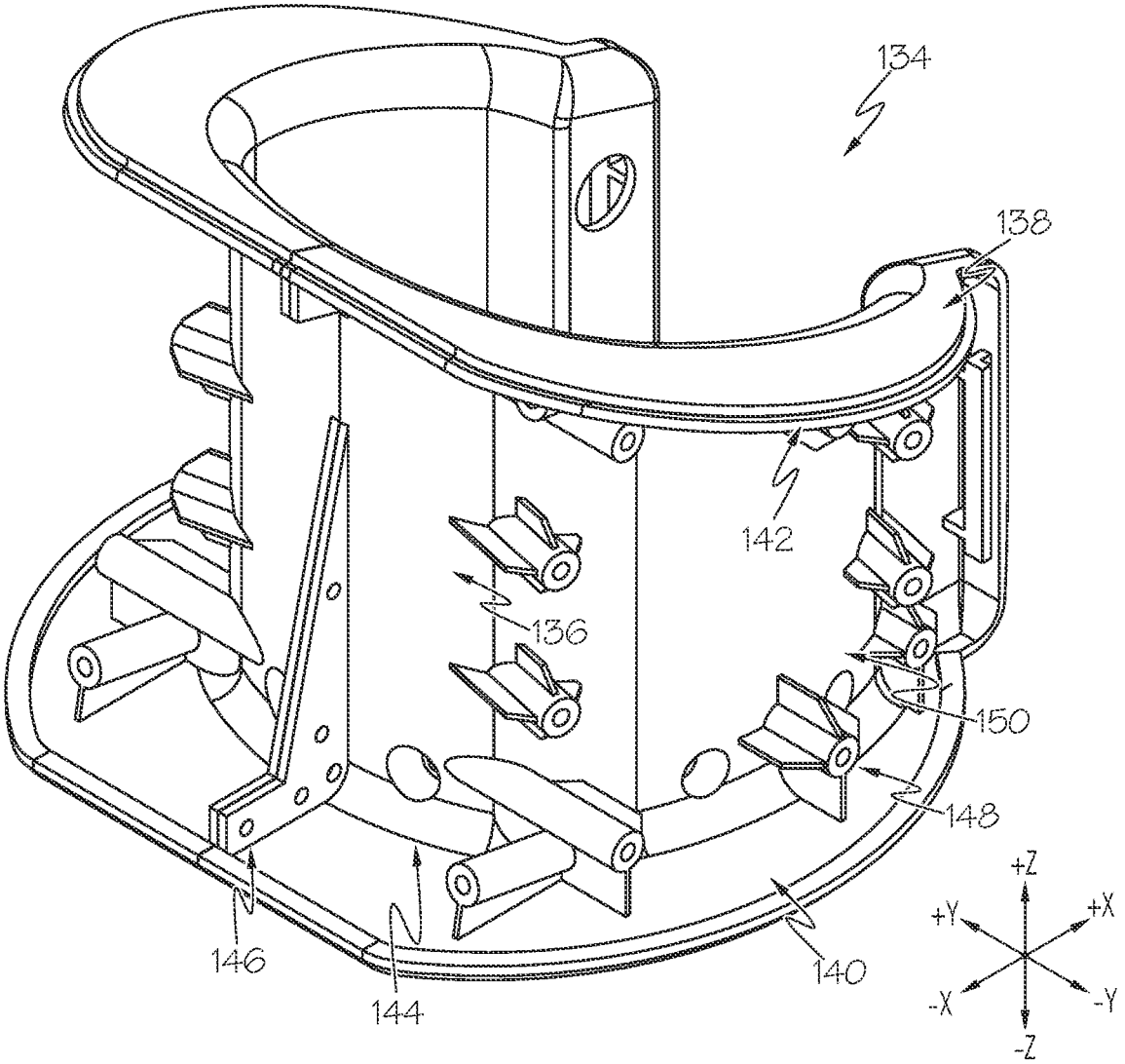
FIG. 13 schematically depicts an isolated perspective view of a front and a right side of an interface frame without shrouds of the example pump controller assembly of FIG. 7 according to one or more embodiments shown and described herein.
Figure 14:
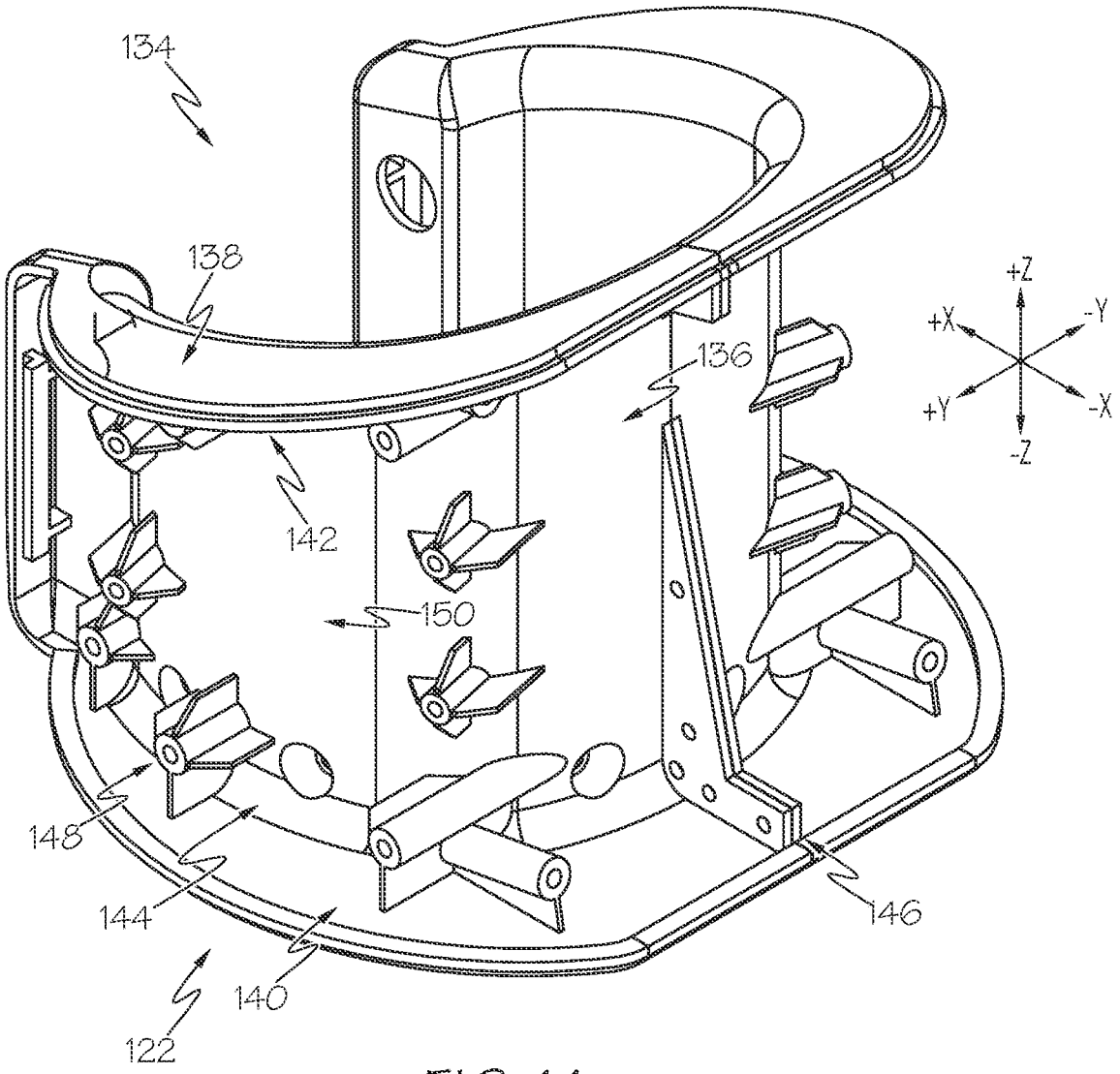
FIG. 14 schematically depicts an isolated perspective view of a front and left side of the interface frame without shrouds of the interface frame without shrouds of FIG. 7 according to one or more embodiments shown and described herein.
Figure 15:
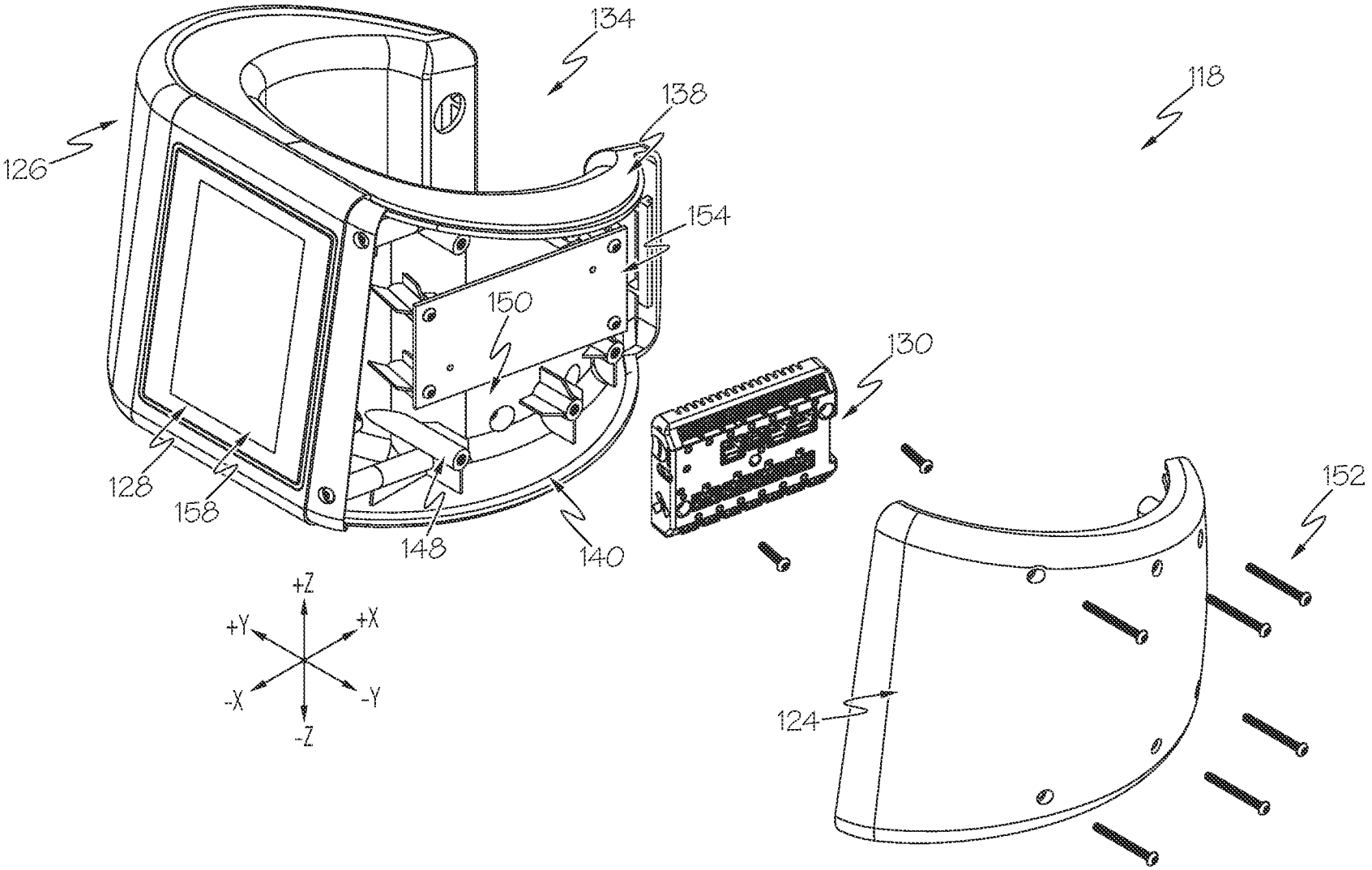
FIG. 15 schematically depicts a partial exploded perspective view of a front and a right side of an interface assembly of the example pump controller assembly of FIG. 7 according to one or more embodiments shown and described herein.
Figure 16:
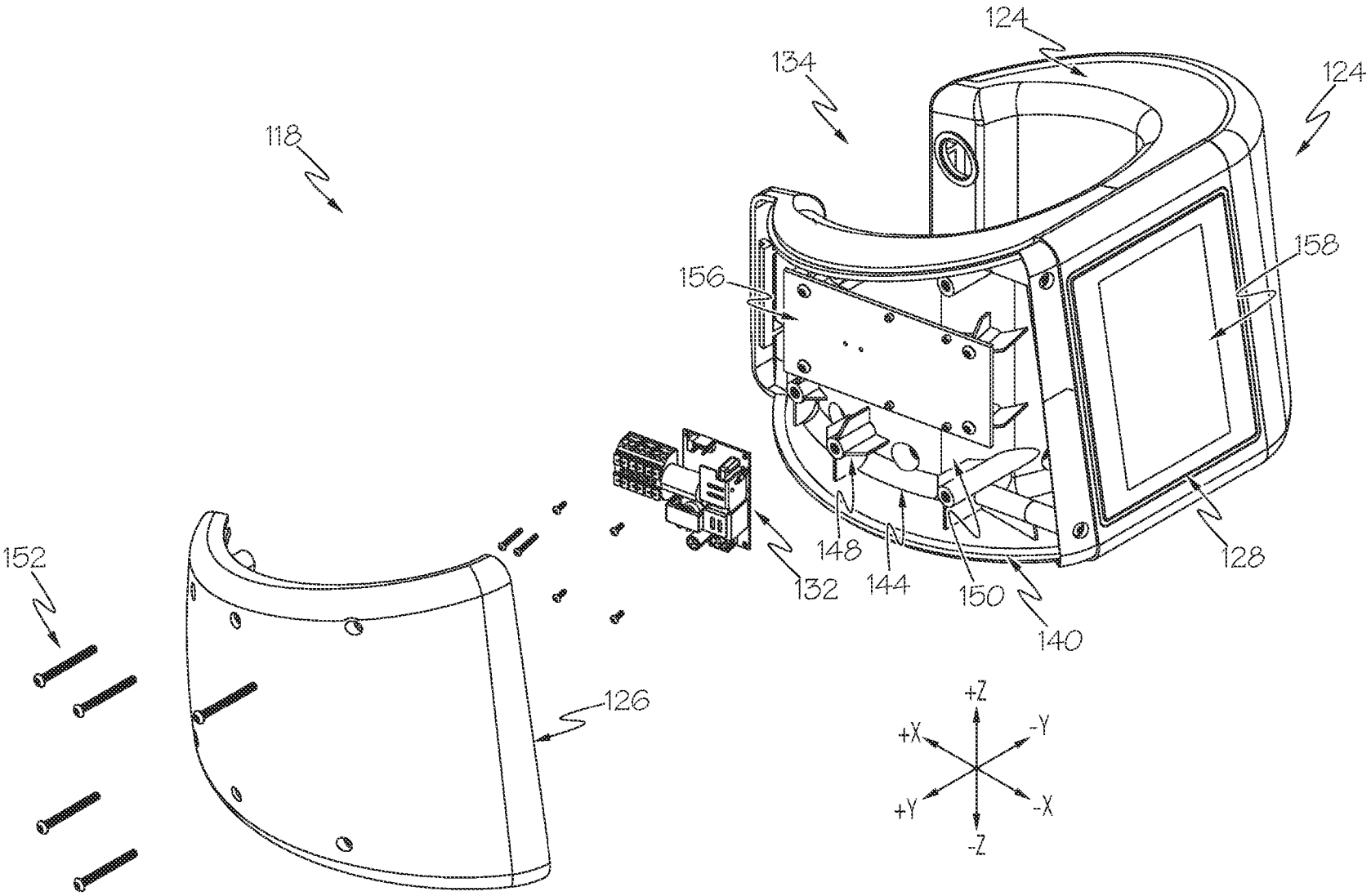
FIG. 16 schematically depicts a partial exploded perspective view of a front and a left side of an interface assembly of the example pump controller assembly of FIG. 7 according to one or more embodiments shown and described herein.
Figure 17:
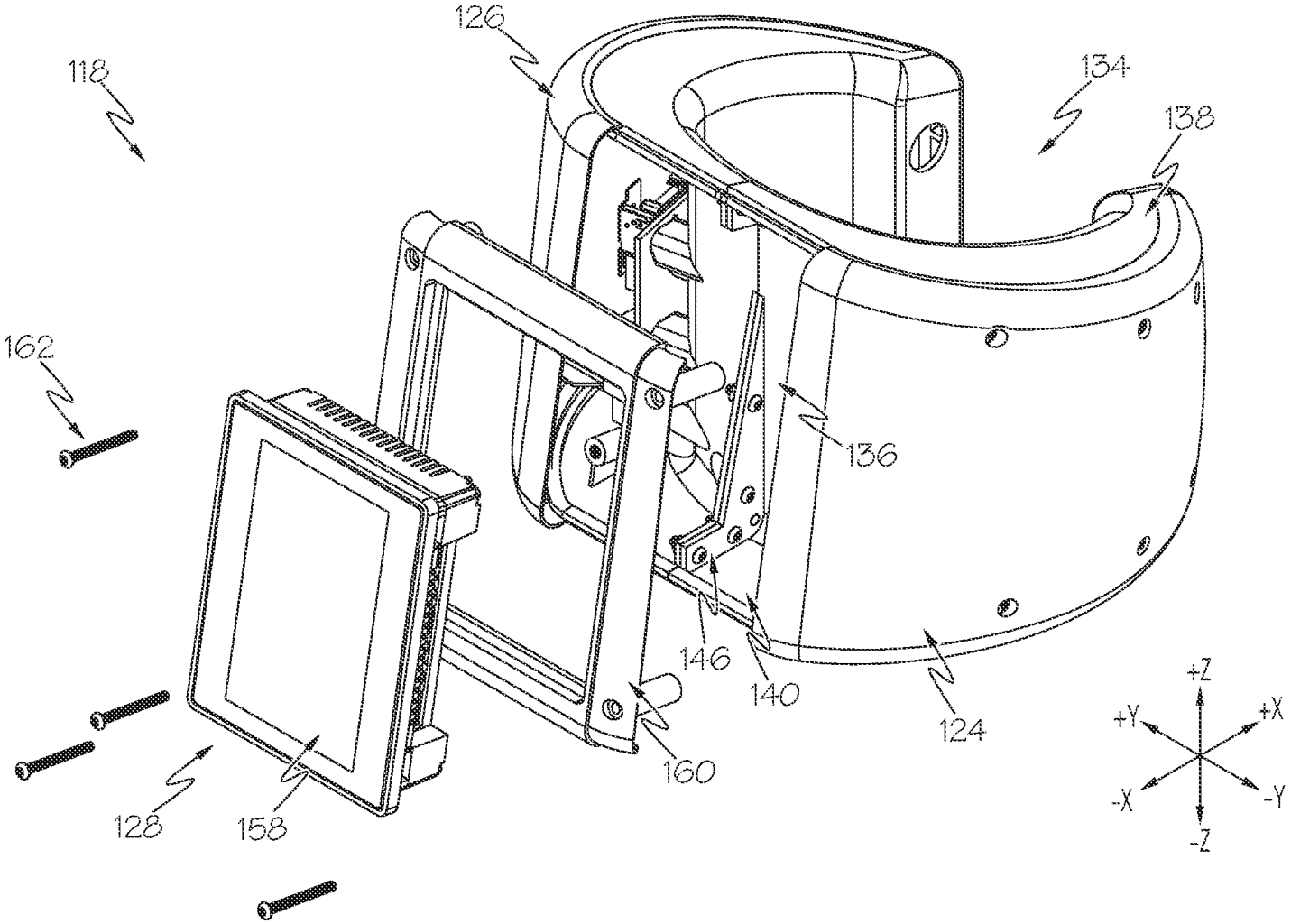
FIG. 17 schematically depicts a partial exploded perspective view of a human machine interface of an interface assembly of the example pump controller assembly of FIG. 7 according to one or more embodiments shown and described herein.

Still referring to FIGS. 1-5B and now FIG. 6, in this example, the pump 12 includes one or more inputs and outputs (I/O) 80 and one or more sensors 78 to communicatively couple the pump 12 and operations thereof, to other components of the pump controller assembly 10, as discussed in greater detail herein.

Now referring back to FIGS. 1-5B, in various embodiments, the gearbox 14 is a mechanical transmission device that connects the servomotor 16 to the pump 12 to modify the torque and speed between the servomotor 16 and the pump 12. In some aspects, the gearbox 14 may be a worm gear reducer. In other aspects, the gearbox 14 may be other types of reducers, such as a two-stage reducer, a compound gear train, an inline planetary gear, a spur, a rack and pinion, a hypoid, and/or the like. The gearbox 14 may generally be an "L" shape. As such, the gearbox 14 may be positioned to couple to a rear side 20 of the pump 12 extending in a longitudinal direction (i.e., in the +/−X direction) and a flange portion 15 extending in a vertical direction (i.e., in the +/−Z direction) to couple to a mating portion 23*a* of the servomotor 16 positioned at a mating end of the servomotor 16. The mating portion 23*a* may provide access to the servomotor 16 gearing, operational mechanics, and the like. The mating portion 23*a* may be coupled to the flange portion 15 via at least one fastener, such as, without limitation, a bolt and nut, screw, rivet, adhesive, epoxy, weld, and/or the like. In some cases, the gearbox 14 may change the direction of the rotational motion of the pump 12, such as in a perpendicular direction in the depicted example.

The servomotor 16 is positioned is an arrangement between the gearbox 14 and the interface assembly 18 in the vertical direction (i.e., in the +/−Z direction). As such, in some aspects, portions of the servomotor 16 are positioned above the pump 12 in the vertical direction (i.e., in the +/−Z direction) to mechanically couple the gearbox 14 to the servomotor 16.

Still referring to FIGS. 1-5B and now to FIG. 6, in various embodiments, the servomotor 16 is a rotary actuator or linear actuator that allows for precise control of angular or linear position, velocity and acceleration using an encoder 72 or other position sensor for feedback. In this example, the servomotor 16 may include one or more inputs and outputs (I/O) 76, the encoder 72, and one or more sensors 74. Note that in some embodiments, servomotor 16 may omit the I/O 76, the encoder 72, and/or the one or more sensors 74.

The servomotor 16 may be, for example, 3-phase, synchronous, permanent magnet, and brushless, which may provide accuracy of 0.001% or better. As such, the servomotor 16 may be operated at very low speeds (e.g., varying revolutions per minutes and may be a varying frequencies). In some embodiments, servomotor 16 accepts a digital input (e.g., "pulses") rather than a varying frequency, which is common to a traditional AC induction motor or permanent magnet AC motor (PMAC). Further, in some embodiments, the servomotor 16 is configured to accept different voltages (e.g., 120 V-240 V and one or three phase), is controllable by a series of pulses, and may use pulse width modulation. As such, the servomotor 16 beneficially eliminates the need for a standalone variable frequency drive, such as those found in conventional assemblies. Because the variable frequency drive can be eliminated, embodiments described herein using servomotors can be used on a GFCI circuit breaker, making them safer to operate. Note that while servomotor 16 is described herein with respect to various embodiments, other types of controllable motors may be used in other embodiments, including PMAC and brushless DC (BLDC) motors.

The servomotor 16 in combination with the enclosure assembly 17 and the interface assembly 18 provides for the ability to have a fine control of the pump 12 beyond the control that is permitted in conventional systems and pumps (e.g., in a range less than 2 Hz and up to and beyond the 120 Hz), as discussed in greater detail herein. Further, the servomotor 16 provides the ability for the pump 12 to run across a wider range of speeds without having to change the gearbox 14 and without a variable frequency drive. These benefits compared to conventional pump assemblies allow for pump controller assembly 10 to be used in a wider variety of applications with increased fidelity.

Now referring to FIGS. 1-2B, 5A-5B, and 6, in one aspect, the interface assembly 18 is coupled to a support member 24 that may be coupled to and positioned generally above the pump 12 and the servomotor 16 in the vertical direction (i.e., in the +/−Z direction). The interface assembly 18 includes a housing 26, a human machine interface 28, and a plurality of communication ports 30 that commutatively couple the interface assembly 18 to the enclosure assembly 17. In the depicted embodiment, the housing 26 includes a front frame portion 32*a*, an opposite rear wall 32*b*, a pair of side walls 32*c*, 32*d* and a pair of end walls 32*e*, 32*f*. The plurality of communication ports 30 are positioned in the rear wall 32*b*. The front frame portion 32*a* includes an opening 34 such that a touchscreen display portion 36 of the human machine interface 28 is positioned to output display data through the opening 34.

The plurality of communication ports 30 may include a power connector 31*a*, at least one Ethernet to M-12 female 4-pole connector 31*b*, and a USB-A to USB-B panel mount receptacle 31*c*. The power connector 31*a* may be a 5-pin female M-12 cable connector. Each of the power connector 31*a*, the at least one Ethernet to M-12 female 4-pole connector 31*b*, and the USB-A to USB-B panel mount receptacle 31*c* may be used in combination to communicatively couple the human machine interface 28 to the enclosure assembly 17, as discussed in greater detail herein.

The support member 24 may include a pair of legs 25*a*, 25*b* coupled to one another at a connecting portion 25*c* and includes a base portion 25*d* with an upper surface 27*a* and an opposite lower surface 27*b* that may directly couple to the servomotor 16. That is, the pair of legs 25*a*, 25*b* may each include a flange portion 25*f* configured to couple to the upper surface 27*a* of the base portion 25*d* and the lower surface 27*b* may be coupled the base portion 25*d* to the servomotor 16. Each of the flange portions 25*f* may be coupled to the upper surface 27*a* of the base portion 25*d* via at least one fastener, such as, without limitation, bolt and nut, screw, rivet, adhesive, epoxy, weld, and/or the like. The base portion 25*d* may be coupled to an upper portion 23*b* of the servomotor 16 (e.g., opposite of the mating portion 23*a*) via at least one fastener, such as, without limitation, bolt and nut, screw, rivet, adhesive, epoxy, weld, and/or the like.

Figure 2A:
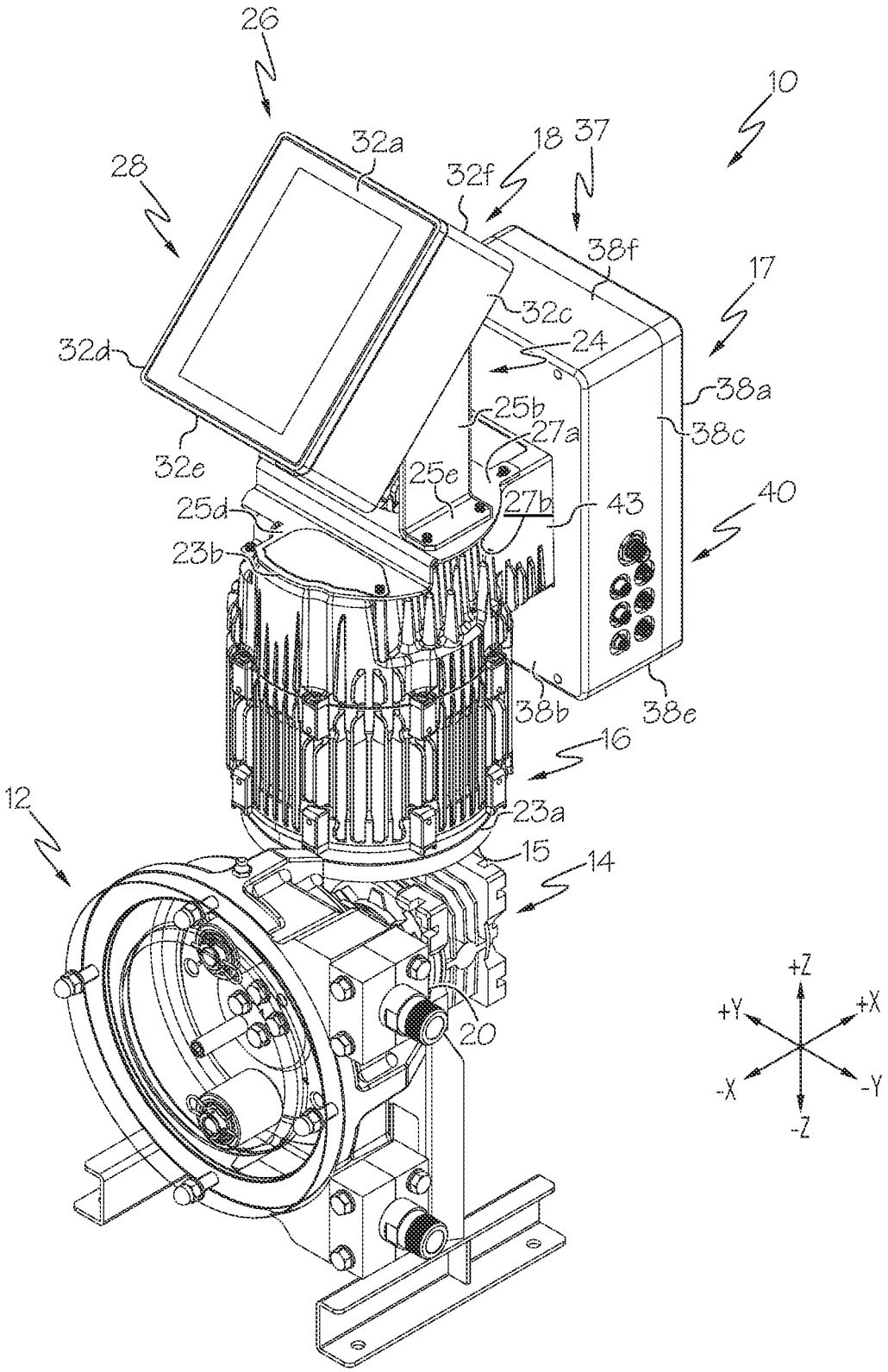
FIG. 2A schematically depicts an isolated perspective view of a primary example pump controller assembly of FIG. 1 according to one or more embodiments shown and described herein.
Figure 2B:
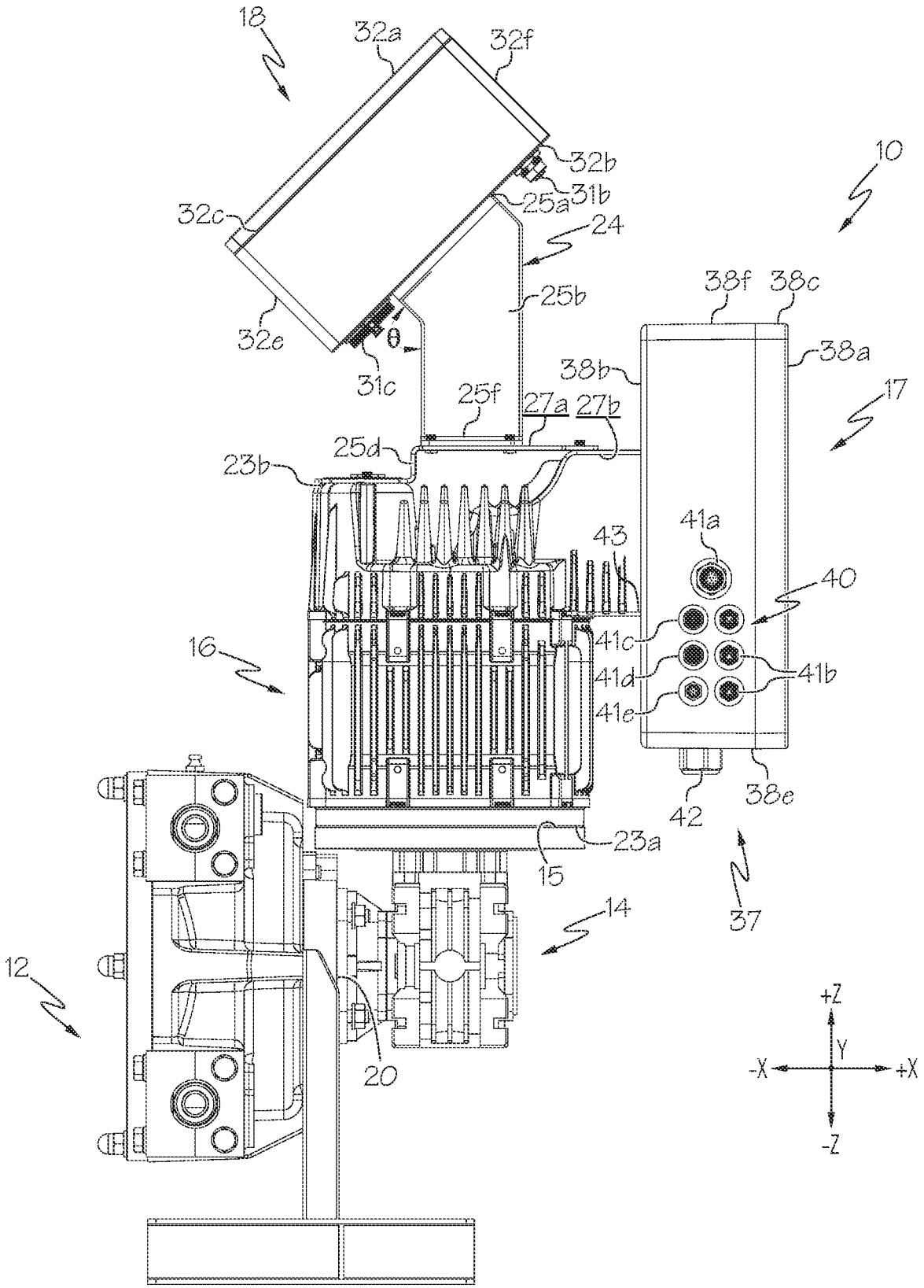
FIG. 2B schematically depicts an isolated side view of the primary example pump controller assembly of FIG. 1 according to one or more embodiments shown and described herein.
Figure 3:
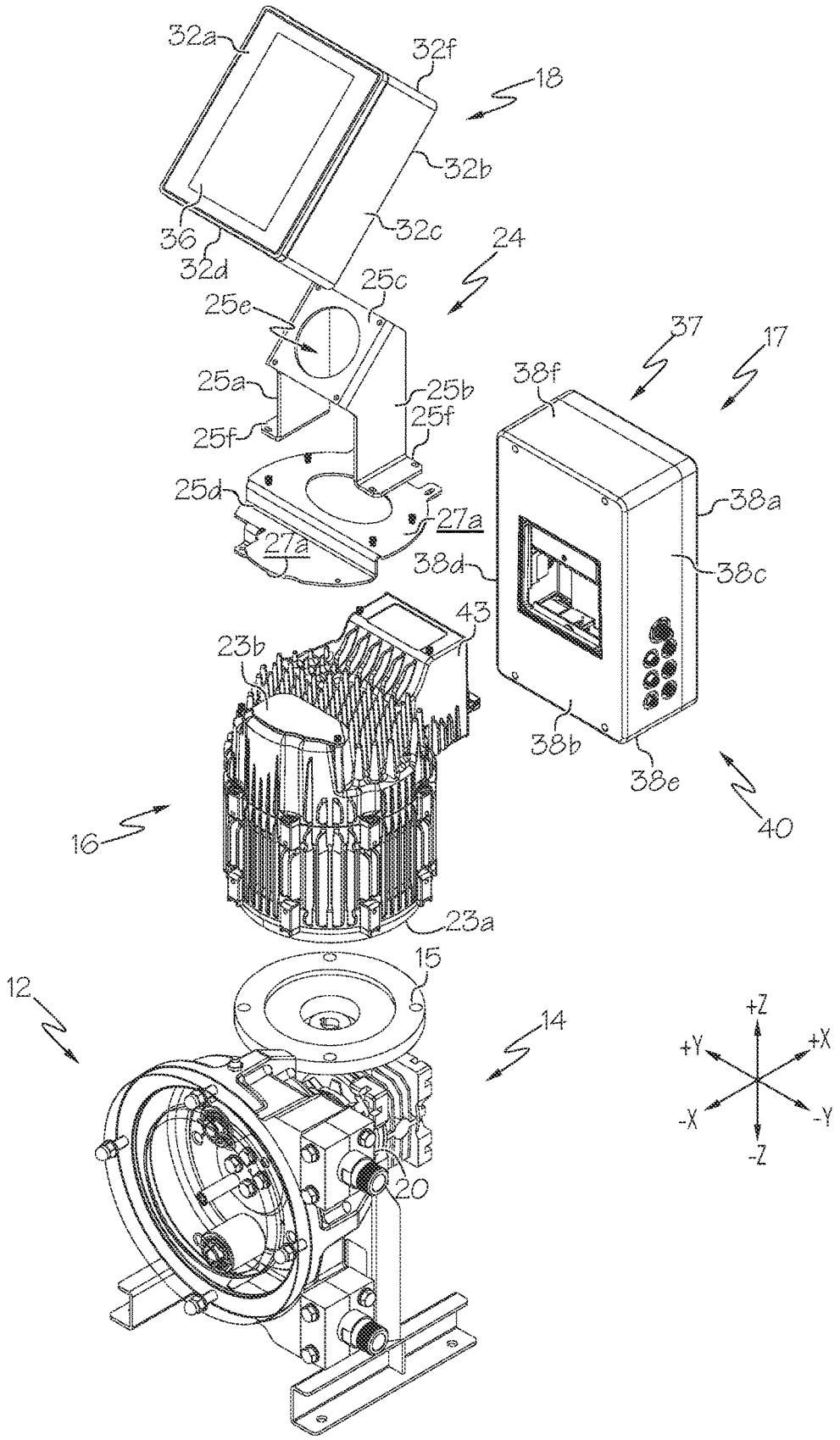
FIG. 3 schematically depicts an isolated exploded view of the primary example pump controller assembly of FIG. 1 according to one or more embodiments shown and described herein.
Figure 4:
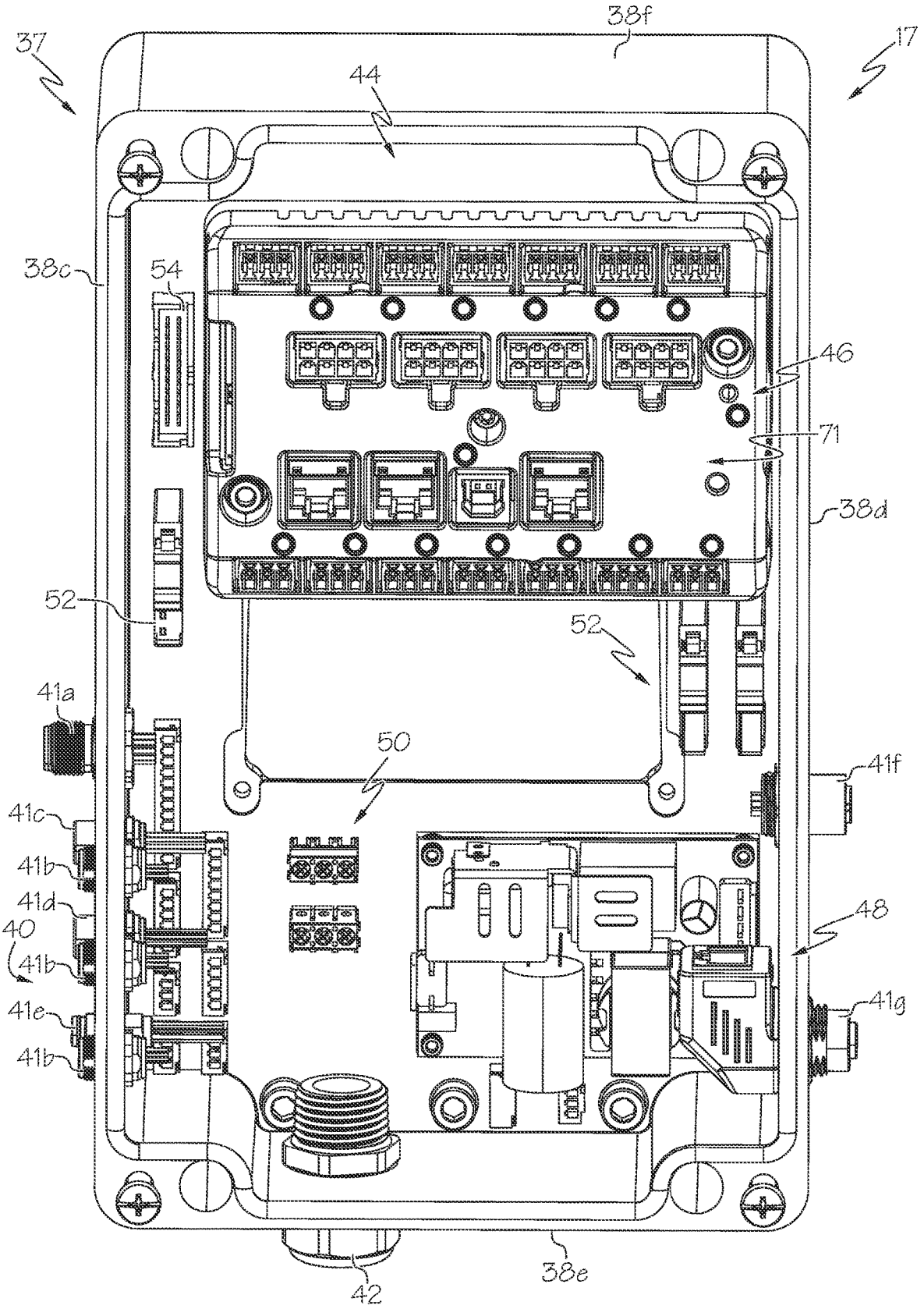
FIG. 4 schematically depicts an isolated interior view of an example enclosure assembly of the pump controller assembly of FIG. 1 according to one or more embodiments shown and described herein.
Figure 5A:
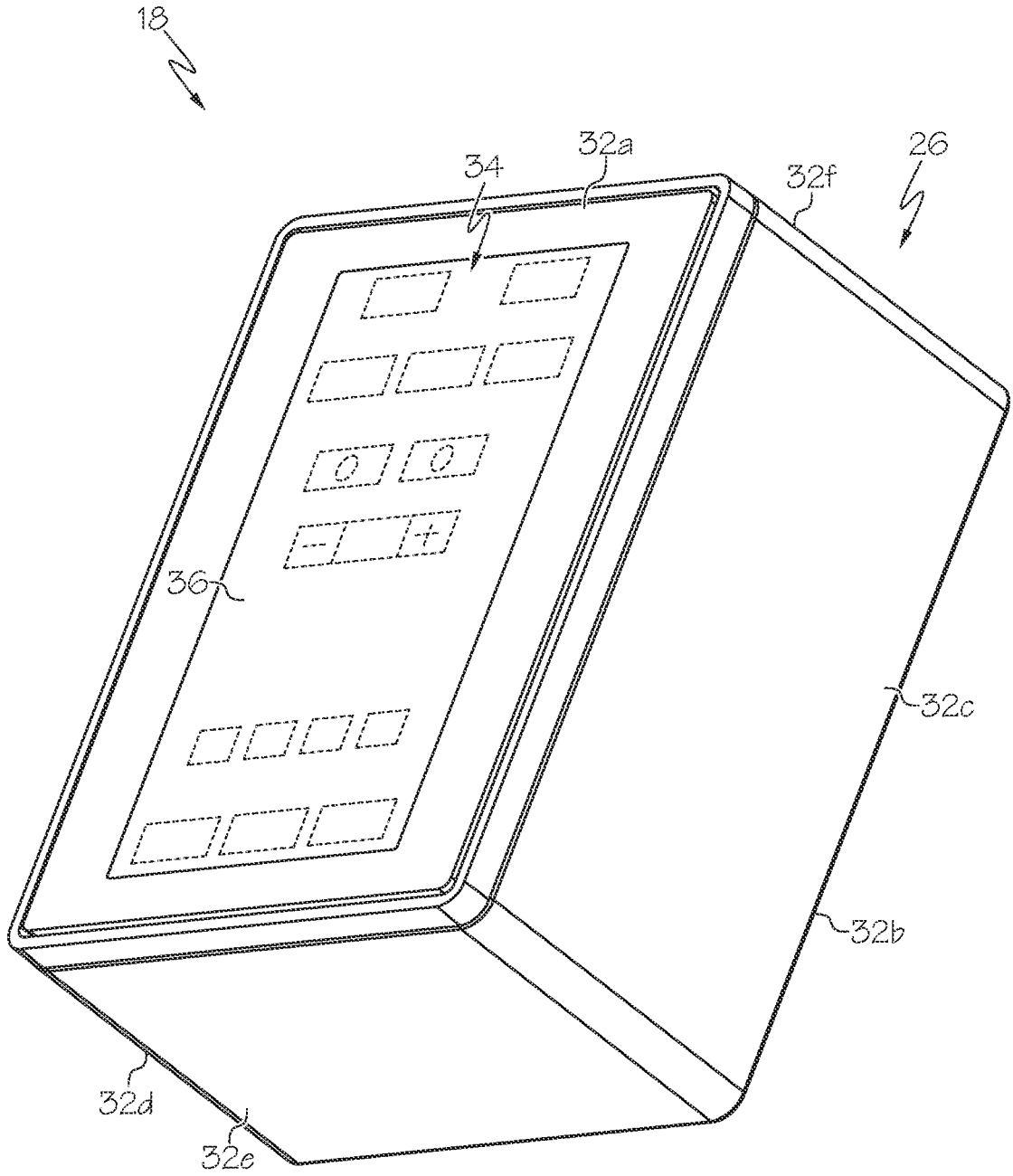
FIG. 5A schematically depicts an isolated perspective of a side and front view of an example interface assembly of the pump controller assembly of FIG. 1 according to one or more embodiments shown and described herein.
Figure 5B:
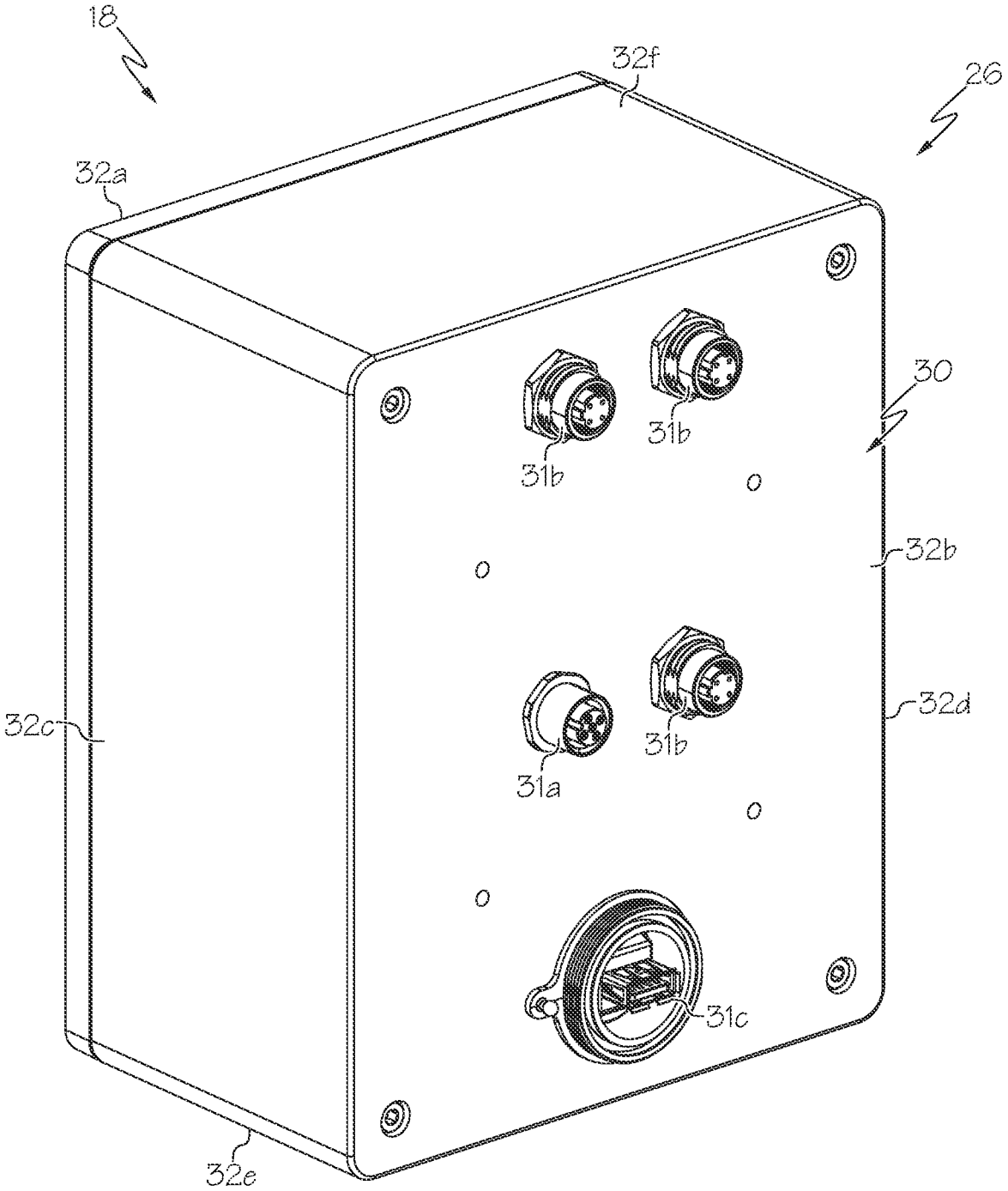
FIG. 5B schematically depicts an isolated perspective of a side and rear view of the example interface assembly of the pump controller assembly of FIG. 1 according to one or more embodiments shown and described herein.

The connecting portion 25*c*, in the depicted aspect, may be angled, such as at 45 degrees with respect to the pair of legs 25*a*, 25*b*, depicted in FIG. 2B by arc θ, and/or with respect to the upper portion 23*b* of the servomotor 16. In other aspects, the connecting portion 25*c* may be at any angle, including zero degrees. It should be appreciated that the angle may be adjusted or changed to optimize the viewing angle of the touchscreen display portion 36. The connecting portion 25*c* may include an aperture 25*e* and may be configured to directly couple to the rear wall 32*b* such that the aperture 25*e* provides access to the plurality of communication ports 30 extending from the rear wall 32*b* of the housing 26 of the interface assembly 18. The support member 24 holds or supports the interface assembly 18 in a position such that the end wall 32*e* is spaced apart from and above the servomotor 16 in the vertical direction (i.e., in the +/−Z direction).

In some aspects, the support member 24 may be configured to be a graspable portion of the pump controller assembly 10 so that a user may grab and move it from place to place. Though not depicted, the interface assembly may include cooling vents and/or other structures designed to conduct heat away from electronic components (such as forced air, fan cooled) housed within the interface assembly 18.

Still referring to FIGS. 1-2B, 5A-5B, and 6, the human machine interface 28 may include at least one module 82 that permits for the touchscreen display portion 36 of the graphical user interface, at least one module 84 that receives the tactile input of the touchscreen, and at least one module 86 that links or otherwise connects the human machine interface 28 to the controller 46 and other components of the pump controller assembly 10. In some embodiments, the human machine interface 28 may also include a separate processor, logic modules, and database to perform the functionality described herein and may be communicatively coupled to the controller 46.

In the depicted embodiment, the human machine interface 28 includes a touchscreen display portion 36 to allow for tactile input and display a graphical user interface to provide a user with the operating conditions as well as allow the user to program predetermined parameters into the system. For example, the user may program the different operating modes, change parameters based on a calendar (e.g., different for days of week, hours of day, and the like). As such, the human machine interface 28 is communicatively coupled to the controller 46 and to other components of the interface assembly 18 such that inputs and outputs of the human machine interface 28 communicates with all the components of the pump controller assembly 10.

In other aspects, the interface assembly 18 is positioned remote from the pump controller assembly 10 and may be communicatively coupled to the pump controller assembly 10 via wired and/or wireless technologies. As such, the at least one module 84, the at least one module 86, and/or other components of the human machine interface 28 may provide for wireless communication to the enclosure assembly 17 using industrial communication protocols, such as, without limitation, PROFINET®, EtherNet/IP®, Modbus® TCP, Modbus® RTU, CANopen®, SAE J1939, EtherCAT and other wireless communication protocols may include Wi-Fi, Zigbee®, Bluetooth®, DigiMesh™, LORAWAN, Cellular, 900/868. Radio Frequency (RF), and others.

As such, users may be select, choose, or enter desired flow pump rates at the pump controller assembly 10 or remote from the pump controller assembly 10 via the human machine interface 28. For example, there may be predetermined selections or modes for velocity (accurate speed control), duration (dose), and volume (dose), as discussed in greater detail herein.

Further, it should be appreciated that in some aspects, the pump controller assembly 10 does not include the human machine interface 28, but instead uses a potentiometer or other analog type of electrical controller.

It should be understood that the pump controller assembly 10 may be used indoors or outdoors and may have an environmental rating of NEMA 4X, IP66 (water/dust proof) in various embodiments. As such, the touchscreen display portion 58 of the human machine interface 28 may be rated for outdoor use.

In some embodiments, security type fasteners may be used to reduce access to non-authorized personnel, which is beneficial when the pump controller assembly 10 is accessible to the general public or accessible by personnel not intended to interact with equipment.

Now referring to FIGS. 1-4 and 6, the enclosure assembly 17 may be defined by a housing 37 that includes a cover 38*a*, an opposite rear wall 38*b*, a pair of sidewalls 38*c*, 38*d* and a pair of end walls 38*e*, 38*f*. A cord grip bushing 42 may be positioned to extend through the end wall 38*e*. A plurality of field connectors 40 are positioned in the sidewall 38*c*. In a non-limiting example, the plurality of field connectors 40 may include a 12-pin M-12 male connector 41*a*, at least one 3-pin M-8 female connector 41*b*, an 8-pin M-8 female connector 41*c*, a 5-pin M-8 female connector 41*d*, and a 6-pin M-8 male connector 41*e*. Further, in another non-limiting example, the other sidewall 38*d* may include a 5-pin female cable connector 41*f* and at least one Ethernet to M-12 female 4-pole connector 41*g*.

The housing 37 of the enclosure assembly 17 may house or include a circuit board 44 that communicatively couples a controller 46, a power supply 48, a plurality of terminal blocks 50, and at least one relay 52 to one another along with the plurality of field connectors 40, the 5-pin female cable connector 41*f* and the at least one Ethernet to M-12 female 4-pole connector 41*g*. The circuit board 44 may further include a 20-pin vertical connector 54. The circuit board 44 may be a printed circuit board (PCB), single layer, multi-layer, rigid board, flexible board, and the like.

As such, the enclosure assembly 17 provides options to use the plurality of terminal blocks 50, the plurality of field connectors 40, or both, depending on the desires of the user and permits flexibility to the type of pump setup. The enclosure assembly 17 may be coupled to a bracket portion 43 extending from the servomotor 16 to be positioned behind the servomotor 16 in the longitudinal direction (i.e., in the +/−X direction). That is, the rear wall 38*b* may be coupled to the bracket portion 43 of the servomotor 16. In some aspects, both the bracket portion 43 of the servomotor 16 and the base portion 25*d* of the support member 24 are coupled to the rear wall 38*b* of the housing 37 of the enclosure assembly 17. In some aspects, the enclosure assembly 17 may be coupled to the bracket portion 43 extending from the servomotor 16 and/or to both the bracket portion 43 extending from the servomotor 16 and the base portion 25*d* of the support member 24 via at least one fastener, such as, without limitation, bolt and nut, screw, rivet, adhesive, epoxy, weld, and/or the like.

In this embodiment, as best depicted in FIG. 6, the controller 46 includes a processor 64, memory components 66 that include logic modules 68, and a database 70. As such the controller 46 may be a central processing unit (CPU), electronic control unit (ECU), and the like. Note that processor 64 may be representative of one or more processors. The logic modules 68 may include, for example, executable code that causes the controller 46 to control various aspects of a pump controller assembly 10, including the servomotor 16 and the pump 12. For example, the controller 46 may apply or transmit control signals to the servomotor 16 in the form a varying pulse signals, which in turn activate the servomotor 16 to drive the pump 12. The controller further includes one or more inputs and outputs (I/O) 71 that may be used for connecting to and exchanging data with (e.g., receiving from and/or sending to) other aspects of the pump controller assembly 10.

For example, the controller 46 may be configured to receive data from the human machine interface 28, from sensors of the servomotor 16 such as the encoder 72, sensors 74 such as position sensors, angular sensors, and the like, and various input/output 76 of the servomotor 16 such as overvoltage and undervoltage, overcurrent, terminal temperature or motor load. Further, data from other external sensors 78 of the pump 12, such as, without limitation, pressure sensors, flow sensors, temperature sensors, and the like may be received by the controller 46. Additionally, other inputs/outputs 80 of the pump 12 such as a pump on, a pump off, an emergency stop, a phase loss, a voltage trip, and the like, may be data received by the controller 46. Further, the controller 46 may be configured to perform predetermined logic functions such as control a torque of the servomotor 16 to accurately control a flowrate of the pump 12. Further, the controller 46 may store and use predetermined modes such as velocity (accurate speed control), duration (dose), and volume (dose).

Additionally, the controller 46 may be linked to multiple "node" controllers, as best illustrated in FIG. 1, with the pump controller assembly 10', and the pump controller assembly 10", greatly simplifying and improving the capabilities of multi-pump deployments. Such an arrangement provides significant cost savings as "node" controllers may be supplied headless (without the human machine interface) and can provide traditional multi-pump features such as lead/lag, duplex, triplex, quadplex, and standby capabilities for mission critical applications. For example, the controller 46 may connect to a plurality of "node" pumps (e.g., five or more), providing independent or group control capabilities from a single user interface.

In some embodiments, control of various aspects of a pump controller assembly 10 is split between controller 46 and the human machine interface 28. The partitioning of control functionality between controller 46 and the human machine interface 28 in certain embodiments allows for modularity, including, for example, a headless (no display) embodiment that has curated functionality, such as speed control, direction, start/stop, and basic safety features. In such an embodiment, controller 46 may function as a standalone controller for basic functionality or connect to an HMI (e.g., 28) or other controller (e.g., over network connection) for enhanced functionality.

Further, the controller 46 and the human machine interface 28 of the pump controller assembly 10 may be configured to screen mirror the display of the human machine interface 28 on a remote computing system, such as a web browser of a personal electronic device, such as a personal computer, tablet, smart phone, and the like, allowing the operator to control the pump(s) using the same familiar interface found on human machine interface 28. This functionality may be useful for simplified remote control, may assist with undesirable conditions associated with remote operation, and may reduce costs associated with operator training.

Additionally, the human machine interface 28 may provide user accounts (multi-tiered) that are password protected and restrict access and control based on pre-defined user roles and authorizations. Further, multi-factor authentication (MFA) may be used for network-enabled systems (e.g., systems with access to the internet and/or other HTTP endpoints).

Still referring to FIGS. 1-4 and 6, the power supply 48 may be a DC power supply and may be communicatively coupled to the human machine interface 28, the terminal block 50, the plurality of field connectors 40, and/or the controller 46. The power supply 48 may be positioned into a sub-box for Underwriters Laboratory (UL) listing and to provide a barrier between high voltage and low voltage within the interface assembly 18.

It should be appreciated that while conventional systems may be operated locally using a local interface, such as switches, buttons, or a touchscreen, or remotely controlled via wired or wireless switches, sensors or centrally managed via industrial communication protocols on supervisory control and data acquisition (SCADA) type networks, the pump controller assembly 10 provides traditional local and remote-control capabilities, plus the ability to be added to the Internet of Things (IOT) ecosystem when connected to the internet. Further, the pump controller assembly 10 may use industrial communication protocols such as PROFINET®, EtherNet/IP®, Modbus® TCP, Modbus® RTU, CANopen®, SAE J1939, EtherCAT and other wireless communication protocols may include Wi-Fi, Zigbee®, Bluetooth®, DigiMesh™, LORAWAN, Cellular, 900/868 Radio Frequency (RF), and others.

In the depicted embodiments, the pump controller assembly 10 is a combination of display, controller, servomotor, and inputs and outputs for controlling a positive displacement pump. The arrangement of the pump controller assembly 10 provides for a greatly increased turndown ration, such as 128,000:1 or greater, is able to operate over the full range, and can run higher pressures than conventional systems. As such, the pump controller assembly 10 has overcome the limitation of traditional 60:1 maximum turndown and achieved a turn down of 128,000:1 (0.001-128 RPM) at maximum output pressure of 232 PSI or greater. Further, the pump controller assembly 10 permits for a high degree of control (turndown), which also provides a longer life expectancy of the pumps, and due to the open and modular design of the peristaltic hose pump, they are now field repairable providing a lower cost of ownership with a longer life expectancy.

In various embodiments, general specifications of a pump controller assembly, such as the pump controller assembly 10, may include, without limitation:

| | |
|---|---|
| Main Power: | 100-240 V 1 PH 50/60 Hz.<br>200-380 V 3 PH 50/60 Hz.<br>12 A Max @ 100 V, GFCI Compatible<br>6 A Max @ 240 V |
| Control Power | 24 VDC, Power Factor Correction |
| HMI Display: | 7" TFT Color display, LED Backlight, Capacitive Touchscreen, Glass Front, Compatible with operator gloves. |
| Operating Conditions: | (Ambient)-20 . . . 60° C., 5 . . . 85% relative humidity, non-condensing |
| Motor: | 3-phase, synchronous, permanent magnet, brushless, servo motor<br>Insulation: Class H (+)<br>Accuracy: 0.001% velocity accuracy<br>Encoder: 64,000 counts per revolution<br>Available Sizes: NEMA 56, 143, & IEC D100 |
| Turndown: | 128,000: 1 (KECO ™ S Series Peristaltic Hose Pumps) |
| Control Module: | 32-Bit ARM Processor Operating @ 120 MHz<br>Overcurrent Protection On All Outputs<br>Inductive Clamping On All Outputs.<br>Board Master Overvoltage And Overcurrent Protection<br>ESD Protection Features On All I/O Circuits.<br>Real Time Clock With Battery Backup, Non-Volatile Memory<br>I/O State And Exception Status On Dedicated Leds<br>Backup Via SD Card Or USB Drive<br>Dynamic Software Updates, Local Or Remote<br>All Configuration Of I/O Hardware Is Controlled By Software, I.E., No Jumpers, DIP Switches, Trim-Pots, Etc. Need To Be Manually Set |

In various embodiments, standard operating modes of a pump controller assembly, such as the pump controller assembly 10, may include without limitation:

- Local
  - Velocity (accurate speed control)
  - Duration (Dose)
  - Volume (Dose)
- Remote
  - Analog (0-20 mA)|(4-20 mA)
  - Voltage (0-10 V)
  - Frequency (0-1000 Hz), 24V Max
- Pulse
  - Volume/Time, Triggered By Input Pulse(s)
  - Digital or Dry Contact Pulse
- Calendar
  - Volume/Time, Triggered By Schedule In various embodiments, operational features of a pump controller assembly, such as the pump controller assembly 10, may include without limitation:

- Calibration Mode
- Internal Pump Leak Detector (Hose Failure)
- Multi Mount Pump Head Rotation
- 128,000:1 Turndown (KECO™ S Series Peristaltic Hose Pumps)
- Predictive Hose Life Estimation With Alert (Algorithm) Includes Manual Set Point
- Clockwise|Counterclockwise Rotation With Action Confirmation
- Power Interruption With User Selectable Restart Options Programmable Maximum Rotor RPM Limit (0.001-128 RPM, KECO™ S Series)
a Revolution/Runtime Counter Trip, Resettable
Revolution/Runtime Lifetime Counter, Non-Resettable
Multiple Analog And Digital Inputs & Outputs
Flow And Low Flow Confirmation Using External Sensing Device
Local And Remote Auto-Prime
Rotor Jog
Event/Error Log
Password Protection In various embodiments, input/output of a pump controller assembly, such as the pump controller assembly 10, may include without limitation:

| | | |
|---|---|---|
| Analog Input | 0-5 V, 0-10 V, 0-20 mA, 4-20 mA | Loop or Non-Loop Powered compatible. |
| Analog Output | 0-10 V, 0-20 mA | 2 wire, 3 wire or 4 wire compatible. |
| Digital Input | Switch or relay contact, NPN sensor or PNP* | *PNP switch W/499Ω/ 2 Watt resistor |
| Digital Input | | |
| Digital Input (Pulse) | | *PNP switch W/499Ω/ 2 Watt resistor |
| Digital Output | 3.3 to 24 VDC Logic Compatible | Solid State Relay Required for Loads exceeding 9 W, Available from Factory or Field Supplied. 5 V/3.3 V Logic Systems may require external clamping diode to logic supply. |
| Digital Output | | |
| Digital Output | | |
| Digital Output | | |
| Frequency Output | 24 VDC | 0-1000 Hz |
| Universal Input | Analog or Digital | Software Defined |

Referring now to FIGS. 7-17, a second embodiment of a pump controller assembly 110 includes a pump 112, a gearbox 114, a servomotor 116, and an interface assembly 118. The pump 112 may be a positive displacement pump such as, without limitation, a gear, lobe, diaphragm, progressive cavity type, and the like. As such, the pump 112 may be a peristaltic type pump. In various embodiments, the pump controller assembly 110 may be a standalone, retrofit, or OEM application pump system that may be directly coupled to an existing pump or mated to any gearbox to increase torque as required. As such, the pump 112 may be mechanically linked or coupled to the gearbox 114. The gearbox 114 may be configured to receive any positive displacement pump and may be interchanged or swapped with differing or the same type pump as needed (e.g., for improved field serviceability).

In various embodiment, the gearbox 114 is a mechanical transmission device that connects the servomotor 116 to the pump 112 to modify the torque and speed between the servomotor 116 and the pump 112. In some aspects, the gearbox 114 may be a worm gear reducer. In other aspects, the gearbox 114 may be other types of reducers, such as a two-stage reducer, a compound gear train, an inline planetary gear, a spur, a rack and pinion, a hypoid, and/or the like. The gearbox 114 may be positioned to couple to a rear side 120 of the pump 112 and extend in a vertical or horizontal direction to couple to the servomotor 116. In some cases, the gearbox 114 may change the direction of the rotational motion of the pump, such as in a perpendicular direction in the depicted example.

The servomotor 116 is positioned is an arrangement between the gearbox 114 and the interface assembly 118 in the vertical direction. As such, in some aspects, portions of the servomotor 116 are positioned above the pump 112 in the vertical direction and the servomotor 116 receives a portion of the gearbox 114 to mechanically couple the gearbox 114 to the servomotor 116.

In various embodiments, the servomotor 116 is a rotary actuator or linear actuator that allows for precise control of angular or linear position, velocity and acceleration using an encoder or other position sensor for feedback. The servomotor 116 may be, for example, 3-phase, synchronous, permanent magnet, and brushless, which may provide accuracy of 0.001% or better. As such, the servomotor 116 may be operated at very low speeds (e.g., rotational frequencies). In some embodiments, servomotor 116 accepts a digital input (e.g., "pulses") rather than a varying frequency, which is common to a traditional AC induction motor or permanent magnet AC motor (PMAC). Further, in some embodiments, the servomotor 116 is configured to accept different voltages (e.g., 120-240 V or three phase), is controllable by a series of pulses, and may use pulse width modulation. As such, the servomotor 116 beneficially eliminates the need for a standalone variable frequency drive, such as those found in conventional assemblies. Because the variable frequency drive can be eliminated, embodiments described herein using servomotors can be used on a GFCI circuit breaker, making them safer to operate. Note that while servomotor 116 is described herein with respect to various embodiments, other types of controllable motors may be used in other embodiments, including PMAC and brushless DC (BLDC) motors.

The servomotor 116 in combination with the interface assembly 118 provides for the ability to have a fine control of the pump 112 beyond the control that is permitted in conventional systems and pumps (e.g., in a range less than 2 Hz and up to and beyond the 120 Hz). Further, the servomotor 116 provides the ability for the pump 112 to run across a wider range of speeds without having to change the gearbox 114 and without a variable frequency drive. These benefits compared to conventional pump assemblies allow for pump controller assembly 110 to be used in a wider variety of applications with increased fidelity.

Still referring to FIGS. 7-17, the interface assembly 118 (alternatively, housing) is positioned generally above the pump 112 and envelops (or surrounds) at least a portion of the servomotor 116. In this way, the interface assembly may serve to shield portions of the servomotor 116 and to protect users from heat generated by and emitted by cooling veins and fins on the servomotor 116. Further, the interface assembly 118 may be configured to be a graspable portion of the pump assembly so that a user may grab and move it from place to place. Though not depicted, the interface assembly may include cooling vents and/or other structures designed to conduct heat away from electronic components (such as forced air, fan cooled) housed within the interface assembly.

The interface assembly 118 includes an interface frame 122 that has a pair of shrouds (or covers) 124, 126 removably coupled to the interface frame 122, a human machine interface 128, a controller 130, and a terminal block 132. It should be understood that the controller 130 may be identical to the controller 46 described above with respect to FIG. 6, and thus will not be further described.

In the depicted embodiment, each of the human machine interface 128, the controller 130, and the terminal block 132 are independently mounted to the interface frame 122 and covered by the pair of shrouds 124, 126 within enclosures formed by the interface frame 122 and the shrouds 124, 126. The interface frame 122 may be generally annular and define an annulus area in which electronic components are mounted. Further, in this embodiment, the interface frame 122 includes an opening 134 in the rear and extending in the vertical direction in varying heights. That is a front portion may extend in vertical direction a greater distance than the opposite rear portion near the opening 134. This is non-limiting, and the height in the vertical direction may be constant or uniform, which may beneficially simplify manufacturing (e.g., the inner and outer shrouds may be designed to be interchangeable and manufacturable via a single mold to reduce tooling costs). Further flanges 138, 140 may extend from both an upper edge 142 and a lower edge 144, respectively. A display surface 136 may be positioned opposite of the opening and configured to receive the human machine interface 128. A gusset 146 extends from the display surface 136 and a plurality of receiving apertures 148 extend from an inner surface 150 of the interface frame 122. Each of the plurality of receiving apertures 148 receive a fastener 152, such as a screw, rivet, dowel pin, and the like, to secure each of the pair of shrouds 124, 126 to the interface frame 122. In some embodiments, security type fasteners may be used to reduce access to non-authorized personnel, which is beneficial when the pump controller assembly is accessible to the general public or accessible by personnel not intended to interact with equipment.

In the depicted embodiment, a pair of base plates 154, 156 are coupled to the interface frame 122 on either side of the display surface 136 via the fastener 152 received in at least one of the plurality of receiving apertures 148. One of the pair of base plates 154 receives the controller 130 while the other base plate 156 receives the terminal block 132. As such, the interface assembly 118 physically separates the high (main) and low (control) electrical voltages. In this example, the terminal block 132 is a modular block with an insulated frame that secures two or more wires together by using a clamping mechanism and a conducting strip.

A retaining frame 160 may be coupled to the display surface 136 of the interface frame 122 via fasteners 162, such as a screw, rivet, and/or the like. In the depicted embodiment, the human machine interface 128 is coupled to the retaining frame 160. In the depicted embodiment, the human machine interface 128 includes a touchscreen display portion 158 to allow for tactile input and display a graphical user interface to provide a user with the operating conditions as well as allow the user to program predetermined parameters into the system. For example, the user may program the different operating modes, change parameters based on a calendar (e.g., different for days of week, hours of day, and the like). As such, the human machine interface 128 is communicatively coupled to the controller 130 and to the terminal block 132 such that inputs and outputs of the human machine interface 128 communicates with all the components of the pump controller assembly 10.

As discussed above with respect to FIG. 6, the human machine interface 128 may be identical to the human machine interface 28 in that it may include the at least one module 82 that permits for the display of the graphical user interface, the at least one module 84 that receives the tactile input of the touchscreen, and the at least one module 86 that links or otherwise connects the human machine interface 128 to the controller 130 and other components of the pump controller assembly 110. In some embodiments, the human machine interface 128 may also include a separate processor, logic modules, and database to perform the functionality described herein and may be communicatively coupled to the controller 130.

In some embodiments, control of various aspects of a pump controller assembly is split between controller 130 and the human machine interface 28. The partitioning of control functionality between controller 130 and the human machine interface 128 in certain embodiments allows for modularity, including, for example, a headless (no display) embodiment that has curated functionality, such as speed control, direction, start/stop, and basic safety features. In such an embodiment, controller 130 may function as a standalone controller for basic functionality or connect to the human machine interface 128 or other controller (e.g., over network connection) for enhanced functionality.

Further, the controller 130 and the human machine interface 128 of the pump controller assembly 110 may be configured to screen mirror the display of the human machine interface 128 on a remote computing system, such as a web browser of a personal electronic device, such as a personal computer, tablet, smart phone, and the like, allowing the operator to control the pump(s) using the same familiar interface found on human machine interface 128. This functionality may be useful for simplified remote control, may assist with undesirable conditions associated with remote operation, and may reduce costs associated with operator training.

Additionally, the human machine interface 128 may provide user accounts (multi-tiered) that are password protected and restrict access and control based on pre-defined user roles and authorizations. Further, multi-factor authentication (MFA) may be used for network-enabled systems (e.g., systems with access to the internet and/or other HTTP endpoints).

It should be understood that the pump controller assembly 110 may be used indoors or outdoors and may have an environmental rating of NEMA 4X, IP66 (water/dust proof) in various embodiments. As such, the touchscreen display portion 58 of the human machine interface 28 may be rated for outdoor use.

In some aspects, a DC power supply may be positioned in the opening 134 of the interface frame 122 and may be communicatively coupled to the human machine interface 128, the terminal block 132, and/or the controller 130. The power supply may be positioned into a sub-box for Underwriters Laboratory (UL) listing and to provide a barrier between high voltage and low voltage within the interface assembly 118.

Further, it should be appreciated that in some aspects, the pump controller assembly 110 does not include the human machine interface 128, but instead uses a potentiometer or other analog type of electrical controller.

It should be appreciated that while conventional systems may be operated locally using a local interface, such as switches, buttons, or a touchscreen, or remotely controlled via wired or wireless switches, sensors or centrally managed via industrial communication protocols on supervisory control and data acquisition (SCADA) type networks, the pump controller assembly 10 provides traditional local and remote-control capabilities, plus the ability to be added to the Internet of Things (IOT) ecosystem when connected to the internet. Further, the pump controller assembly 10 may use industrial communication protocols such as PROFINET®, EtherNet/IP®, Modbus® TCP, Modbus® RTU, CANopen®, SAE J1939, EtherCAT and other wireless communication protocols may include Wi-Fi, Zigbee®, Bluetooth®, DigiMesh™, LORAWAN, Cellular, 900/868. Radio Frequency (RF), and others.

In the depicted embodiments, the pump controller assembly 110 is a combination of display, controller, servomotor, and inputs and outputs for controlling a positive displacement pump. The arrangement of the pump controller assembly 110 provides for a greatly increased turndown ration, such as 128,000:1 or greater, is able to operate over the full range, and can run higher pressures than conventional systems. As such, the pump controller assembly 110 has overcome the limitation of traditional 60:1 maximum turndown and achieved a turn down of 128,000:1 (0.001-128 RPM) at maximum output pressure (232 PSI). Further, the pump controller assembly 110 permits for a high degree of control (turndown), which also provides a longer life expectancy of the pumps, and due to the open and modular design of the peristaltic hose pump, they are now field repairable providing a lower cost of ownership with a longer life expectancy.

In various embodiments, general specifications of a pump controller assembly, such as the pump controller assembly 110, may include the following without limitation:

| | |
|---|---|
| Main Power: | 100-240 V 1 PH 50/60 Hz.<br>200-380 V 3 PH 50/60 Hz.<br>12 A Max @ 100 V, GFCI Compatible<br>6 A Max @ 240 V |
| Control Power | 24 VDC, Power Factor Correction |
| HMI Display: | 7" TFT Color display, LED Backlight, Capacitive Touchscreen, Glass Front, Compatible with operator gloves. |
| Operating Conditions: | (Ambient)-20 . . . 60° C., 5 . . . 85% relative humidity, non-condensing |
| Motor: | 3-phase, synchronous, permanent magnet, brushless, servo motor<br>Insulation: Class H (+)<br>Accuracy: 0.001% velocity accuracy<br>Encoder: 64,000 counts per revolution<br>Available Sizes: NEMA 56, 143, & IEC D100 |
| Turndown: | 128,000: 1 (KECO ™ S Series Peristaltic Hose Pumps) |
| Control Module: | 32-Bit ARM Processor Operating @ 120 MHz<br>Overcurrent Protection On All Outputs<br>Inductive Clamping On All Outputs.<br>Board Master Overvoltage And Overcurrent Protection<br>ESD Protection Features On All I/O Circuits.<br>Real Time Clock With Battery Backup, Non-Volatile Memory<br>I/O State And Exception Status On Dedicated Leds<br>Backup Via SD Card Or USB Drive<br>Dynamic Software Updates, Local Or Remote<br>All Configuration Of I/O Hardware Is Controlled By Software, I.E., No Jumpers, DIP Switches, Trim-Pots, Etc. Need To Be Manually Set |

In various embodiments, standard operating modes of a pump controller assembly, such as the pump controller assembly 110, may include without limitation:

- Local
  - Velocity (accurate speed control)
  - Duration (Dose)
  - Volume (Dose)
- Remote
  - Analog (0-20 mA) (4-20 mA)
  - Voltage (0-10 V)
  - Frequency (0-1000 Hz)
- Pulse
  - Digital|Dry Contact Input
- Calendar
  - Scheduled Operation In various embodiments, operational features of a pump controller assembly, such as the pump controller assembly 110, may include without limitation:

- Calibration Mode
- Internal Pump Leak Detector (Hose Failure)
- Multi Mount Pump Head Rotation
- 128,000:1 Turndown (KECO™ S Series Peristaltic Hose Pumps)
- Predictive Hose Life Estimation With Alert (Algorithm) Includes Manual Set Point
- Clockwise| Counterclockwise Rotation With Action Confirmation
- Power Interruption With User Selectable Restart Options
- Programmable Maximum Rotor RPM Limit (0.001-128 RPM, KECO™ S Series)
- Revolution/Runtime Counter Trip, Resettable
- Revolution/Runtime Lifetime Counter, Non-Resettable
- Multiple Analog And Digital Inputs & Outputs
- Flow And Low Flow Confirmation Using External Sensing Device
- Local And Remote Auto-Prime
- Rotor Jog
- Event/Error Log
- Password Protection In various embodiments, input/output of a pump controller assembly, such as the pump controller assembly 110, may include without limitation:

| | | |
|---|---|---|
| Analog Input | 0-5 V, 0-10 V, 0-20 mA, 4-20 mA | Loop or Non-Loop Powered compatible. |
| Analog Output | 0-20 mA | 2 wire, 3 wire or 4 wire compatible. |
| Digital Input | Switch or relay contact, NPN sensor or PNP* | *PNP switch W/499Ω/ 2 Watt resistor |
| Digital Input | | |
| Digital Input (Pulse) | | *PNP switch W/499Ω/ 2 Watt resistor |
| Digital Output | 3.3 to 24 VDC Logic Compatible | Solid State Relay Required for Loads exceeding 9 W, Available from Factory or Field Supplied. |
| Digital Output | | |
| Digital Output | | 5 V/3.3 V Logic Systems may require external clamping diode to logic supply. |
| Digital Output | | |
| Frequency Output | 24 VDC | 0-1000 Hz |
| Universal Input | Analog or Digital | Software Defined |

Figure 18:
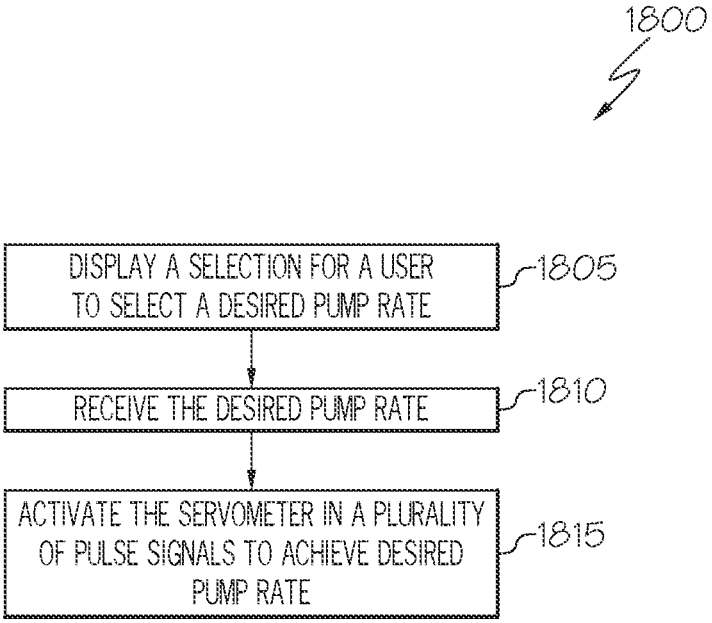
FIG. 18 schematically depicts an example flow chart for operating a system of positive displacement pumps using pump controller assemblies according to one or more embodiments shown and described herein.

Referring now to FIG. 18, a flow diagram that graphically depicts an illustrative method 1800 for operating a system of positive displacement pumps using pump controller assemblies is provided. Although the steps associated with the blocks of FIG. 18 will be described as being separate tasks, in other embodiments, the blocks may be combined or omitted. Further, while the steps associated with the blocks of FIG. 18 will described as being performed in a particular order, in other embodiments, the steps may be performed in a different order. Further, it should be understood that the illustrative method 1800 may apply to the pump controller assembly 10 or the pump controller assembly 110.

At block 1805, the human machine interface displays on a graphical user interface, a selection for a user to select a desired pump rate. The system may include a single human machine interface that is communicatively coupled to each of the enclosure assemblies for each of the pump controller assemblies in the system. As such, a single selection from the user controls all of the pump controller assemblies in the system. It should be appreciated that the human machine interface may be positioned at or near the pump controller assemblies in the system and/or may be positioned remote from and wired or wirelessly communicate with the pump controller assemblies in the system.

At block 1810, the human machine interface transmits the desired selection to each controller for each of the pump controller assemblies in the system such that each controller receives the desired pump rate.

At block 1815, the each controller activates the corresponding or associated servomotor coupled to the positive displacement pump for each of the pump controller assemblies in the system via a plurality of pulse signals to output from the positive displacement pump for each of the pump controller assemblies in the system the desired pump rate.

Additional Considerations

The preceding description is provided to enable any person skilled in the art to practice the various embodiments described herein. The examples discussed herein are not limiting of the scope, applicability, or embodiments set forth in the claims. Various modifications to these embodiments will be readily apparent to those skilled in the art, and the generic principles defined herein may be applied to other embodiments. For example, changes may be made in the function and arrangement of elements discussed without departing from the scope of the disclosure. Various examples may omit, substitute, or add various procedures or components as appropriate. For instance, the methods described may be performed in an order different from that described, and various steps may be added, omitted, or combined. Also, features described with respect to some examples may be combined in some other examples. For example, an apparatus may be implemented or a method may be practiced using any number of the aspects set forth herein. In addition, the scope of the disclosure is intended to cover such an apparatus or method that is practiced using other structure, functionality, or structure and functionality in addition to, or other than, the various aspects of the disclosure set forth herein. It should be understood that any aspect of the disclosure disclosed herein might be embodied by one or more elements of a claim.

As used herein, the word "exemplary" means "serving as an example, instance, or illustration." Any aspect described herein as "exemplary" is not necessarily to be construed as preferred or advantageous over other aspects.

As used herein, a phrase referring to "at least one of" a list of items refers to any combination of those items, including single members. As an example, "at least one of: a, b, or c" is intended to cover a, b, c, a-b, a-c, b-c, and a-b-c, as well as any combination with multiples of the same element (e.g., a-a, a-a-a, a-a-b, a-a-c, a-b-b, a-c-c, b-b, b-b-b, b-b-c, c-c, and c-c-c or any other ordering of a, b, and c).

As used herein, the term "determining" encompasses a wide variety of actions. For example, "determining" may include calculating, computing, processing, deriving, investigating, looking up (e.g., looking up in a table, a database or another data structure), ascertaining and the like. Also, "determining" may include receiving (e.g., receiving information), accessing (e.g., accessing data in a memory) and the like. In addition, "determining" may include resolving, selecting, choosing, establishing and the like.

The methods disclosed herein comprise one or more steps or actions for achieving the methods. The method steps and/or actions may be interchanged with one another without departing from the scope of the claims. In other words, unless a specific order of steps or actions is specified, the order and/or use of specific steps and/or actions may be modified without departing from the scope of the claims. Further, the various operations of methods described above may be performed by any suitable means capable of performing the corresponding functions. The means may include various hardware and/or software component(s) and/or module(s), including, but not limited to a circuit, an application specific integrated circuit (ASIC), or processor. Generally, where there are operations illustrated in figures, those operations may have corresponding counterpart means-plus-function components with similar numbering.

The following claims are not intended to be limited to the embodiments shown herein, but are to be accorded the full scope consistent with the language of the claims. Within a claim, reference to an element in the singular is not intended to mean "one and only one" unless specifically so stated, but rather "one or more." Unless specifically stated otherwise, the term "some" refers to one or more. No claim element is to be construed under the provisions of 35 U.S.C. § 112(f) unless the element is expressly recited using the phrase "means for" or, in the case of a method claim, the element is recited using the phrase "step for." All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims.

Various implementations of systems, methods and devices within the scope of the appended claims each have several aspects, no single one of which is solely responsible for the desirable attributes described herein. Without limiting the scope of the appended claims, some prominent features are described herein.

As used herein the term "and/or" means "and" or "or", or both.

As used herein "(s)" following a noun means the plural and/or singular forms of the noun, unless otherwise noted.

The term "comprising" as used in this specification means "consisting at least in part of." When interpreting statements in this specification that include that term, the features, prefaced by that term in each statement or claim, all need to be present but other features can also be present. Related terms such as "comprise" and "comprised" are to be interpreted in the same manner.

Embodiments described herein may also be said broadly to consist in the parts, elements and features referred to or indicated in the specification of the application, individually or collectively, and any or all combinations of any two or more of said parts, elements or features, and where specific integers are mentioned herein which have known equivalents in the art to which the embodiments herein relate, such known equivalents are deemed to be incorporated herein as if individually set forth.

To those skilled in the art to which the present disclosure relates, many changes in construction and widely differing embodiments and applications of the present disclosure will suggest themselves without departing from the scope of the present disclosure as defined in the appended claims. The disclosures and the descriptions herein are purely illustrative and are not intended to be in any sense limiting.

What is claimed is:

1. A pump controller assembly for a positive displacement pump, the pump controller assembly, comprising:

a servomotor having a bracket, the servomotor configured to operate the positive displacement pump via a gearbox, at least a portion of the servomotor being positioned above the positive displacement pump in a vertical direction;

an enclosure assembly having a housing coupled to the bracket such that the enclosure assembly is spaced apart from the servomotor in a longitudinal direction, the enclosure assembly being communicatively coupled to the servomotor, the enclosure assembly comprising:

a controller, a power supply, a terminal block, and a plurality of field connectors, a support member having a pair of legs and a connecting portion, the connecting portion is angled with respect to the pair of legs, the support member is coupled to the servomotor and to the housing of the enclosure assembly; and a human machine interface positioned above the servomotor in a vertical direction, the human machine interface communicatively coupled to the enclosure assembly, the human machine interface comprising:

a housing coupled to the connecting portion of the support member, such that the housing is angled with respect to the servomotor; and a display touch-screen interface positioned at least partially within the housing, wherein:

the controller is configured to control the servomotor via a plurality of pulse signals, and the controller is configured to receive commands from the human machine interface.

2. The pump controller assembly of claim 1, wherein the connecting portion is angled at 45 degrees.

3. The pump controller assembly of claim 1, wherein the servomotor is configured to provide at least a 128,000:1 turndown ratio.

4. The pump controller assembly of claim 3, wherein the servomotor is configured as a 1.0 horsepower at a 120 volt continuous output and a 1.2 horsepower peak output.

5. The pump controller assembly of claim 3, wherein:

the servomotor is configured as a 2.5 horsepower at a 230 volt three-phase continuous output and a 7.5 horsepower peak output; and the power supply is 100-240 VAC and is one phase and three phase compatible.

6. The pump controller assembly of claim 1, wherein the gearbox is mechanically coupled between the servomotor and the positive displacement pump and configured to provide a coupling between the positive displacement pump and the servomotor.

7. The pump controller assembly of claim 6, wherein the positive displacement pump comprises a peristaltic pump.

8. The pump controller assembly of claim 1, wherein the human machine interface is communicatively coupled to the enclosure assembly via a wired connection.

9. The pump controller assembly of claim 1, wherein the human machine interface is communicatively coupled to the enclosure assembly via a wireless connection.

10. A pump system, comprising:

a controller;

a plurality of servomotors communicatively coupled to the controller and configured for control by the controller;

a plurality of positive displacement pumps, each one of the plurality of positive displacement pumps mechanically coupled to a respective one of the plurality of servomotors via a respective gearbox, at least a portion of each of the respective one of the plurality of servomotors being positioned above the respective on of the plurality of positive displacement pump in a vertical direction;

a plurality of enclosure assemblies, each enclosure assembly of the plurality of enclosure assemblies coupled to the respective one of the plurality of servomotors via a bracket such that each enclosure assembly of the plurality of enclosure assemblies is spaced apart from the respective one of the plurality of servomotors in a longitudinal direction, each enclosure assembly of the plurality of enclosure assemblies being communicatively coupled to the respective one of the plurality of servomotors, each enclosure assembly of the plurality of enclosure assemblies are standalone and spaced apart to be independently operable from one another, each one of the plurality of enclosure assemblies comprising:

a power supply, a terminal block, and a plurality of field connectors, wherein the terminal block or the plurality of field connectors are utilized to communicatively couple the controller to each of the plurality of servomotors; and a human machine interface communicatively coupled to the enclosure assembly, the human machine interface comprising:

a housing coupled to the one of the plurality of servomotors; and a display touch-screen interface positioned at least partially within the housing, wherein:

the controller is configured to control each of the plurality of servomotors via a plurality of pulse signals, and the controller is configured to receive commands from the human machine interface.

11. The pump system of claim 10, wherein the human machine interface is positioned remote from the plurality of enclosure assemblies and the plurality of servomotors.

12. The pump system of claim 10, wherein the human machine interface is coupled to the one of the plurality of servomotors via a support member above the one of the plurality of servomotors in a vertical direction.

13. The pump system of claim 10, wherein each of the plurality of positive displacement pumps comprise a peristaltic pump.

14. The pump system of claim 10, wherein each of the plurality of servomotors are configured to provide at least a 128,000:1 turndown ratio.

15. The pump system of claim 10, further comprising a gearbox mechanically coupled between at least one of the plurality of servomotors and at least one pump of the plurality of positive displacement pumps and configured to provide a coupling between the at least one pump of the plurality of positive displacement pumps and the at least one servomotor of the plurality of servomotors.

16. The pump system of claim 10, wherein the human machine interface is communicatively coupled to each of the plurality of enclosure assemblies via a wired connection.

17. The pump system of claim 10, wherein the human machine interface is positioned remotely from each of the plurality of servomotors.

18. The pump system of claim 17, wherein the human machine interface is communicatively coupled to the plurality of enclosure assemblies via a wireless connection.

19. A method for operating a system having a plurality of positive displacement pumps coupled to a plurality of pump controller assemblies, the method comprising:

displaying, on a human machine interface, a graphical user interface to select a desired pump rate, the human machine interface communicatively coupled to a plurality of enclosure assemblies, each of the plurality of pump controller assemblies in the system having one of the plurality of enclosure assemblies and one of a plurality of servomotors, each one of the plurality of enclosure assemblies coupled to a bracket of a corresponding servomotor of the plurality of servomotors such that each one of the plurality of enclosure assemblies is spaced apart from the corresponding servomotor in a longitudinal direction, the servomotor configured to operate the positive displacement pump via a gearbox, at least a portion of the servomotor positioned above the positive displacement pump in a vertical direction, each enclosure assembly of the plurality of enclosure assemblies having a controller, a power supply, a terminal block, and a plurality of field connectors;

receiving, by the controller for each of the plurality of enclosure assemblies, the desired pump rate; and activating, by the controller for each of the plurality of enclosure assemblies, the corresponding servomotor of the plurality of servomotors via a plurality of pulse signals to output from the corresponding positive displacement pump of the plurality of positive displacement pumps the desired pump rate, wherein the terminal block or the plurality of field connectors of each enclosure assembly of the plurality of enclosure assemblies are utilized to communicatively couple the controller of each enclosure assembly of the plurality of enclosure assemblies to the corresponding servomotor of the plurality of servomotors.

20. The method of claim 19, wherein the human machine interface is communicatively coupled to each of the plurality of enclosure assemblies via a wireless connection.

* * * * *